US012612911B2

(12) United States Patent
Brocker et al.

(10) Patent No.: US 12,612,911 B2
(45) Date of Patent: Apr. 28, 2026

(54) ELECTRIC DIAPHRAGM PUMP WITH OFFSET SLIDER CRANK

(71) Applicant: Ingersoll-Rand Industrial U.S., Inc., Davidson, NC (US)

(72) Inventors: Daniel Brocker, Davidson, NC (US); Ziv Arzt, Davidson, NC (US); James Simmons, Davidson, NC (US); Spencer J. Lynn Zeedyk, Statesville, NC (US); Allen G. Braggs, Mooresville, NC (US); Warren A. Seith, Bethlehem, PA (US)

(73) Assignee: INGERSOLL-RAND INDUSTRIAL U.S., Davidson, NC (US)

( * ) Notice: Subject to any disclaimer, the term of this patent is extended or adjusted under 35 U.S.C. 154(b) by 0 days.

(21) Appl. No.: 18/493,919

(22) Filed: Oct. 25, 2023

(65) Prior Publication Data

US 2024/0068471 A1 Feb. 29, 2024

Related U.S. Application Data

(63) Continuation of application No. 17/858,500, filed on Jul. 6, 2022, now Pat. No. 11,835,043, which is a (Continued)

(51) Int. Cl.
*F04B 15/02* (2006.01)
*F04B 45/047* (2006.01)
(Continued)

(52) U.S. Cl.
CPC ..... *F04C 2/07* (2013.01); *F04B 15/02* (2013.01); *F04B 45/047* (2013.01); *F04C 11/006* (2013.01); *F04B 43/02* (2013.01)

(58) Field of Classification Search
CPC ..... F04B 43/02; F04B 45/047; F04B 15/02; F04C 11/006
See application file for complete search history.

(56) References Cited

U.S. PATENT DOCUMENTS 781,678 A * 2/1905 Richwood ..... F04B 1/053 417/273
2,997,029 A 8/1961 Bennett et al.
(Continued)

FOREIGN PATENT DOCUMENTS

CN 2051679 U 1/1990
CN 102016264 A 4/2011
(Continued)

OTHER PUBLICATIONS

Office Action and Search Report from China National Intellectual Property Administration for Chinese Application No. 202010161297.5 dated Mar. 21, 2024 with English translation, 21 pages.
(Continued)

*Primary Examiner* — Connor J Tremarche
(74) *Attorney, Agent, or Firm* — Edell, Shapiro & Finnan, LLC

(57) ABSTRACT

A diaphragm pump having a crankshaft that is rotatable about a rotational axis and coupled to a piston. The piston is reciprocally displaceable within a piston cylinder along an axis of motion between suction and discharge strokes. A diaphragm housing coupled to the piston cylinder at least partially defines a pumping chamber through which fluid is pumped as the piston reciprocates. The axis of motion, which intersects a connection between the piston and the connecting rod, may not intersect the rotational axis of the crankshaft such that, relative to an arrangement in which the axis of motion does intersect the rotational axis, a peak magnitude of piston side load forces during the discharge stroke is reduced and a peak magnitude of piston side load
(Continued)

forces during the suction stroke is increased so as to attain an improved balance between the peak magnitudes of piston side load forces of the discharge and suction strokes.

20 Claims, 16 Drawing Sheets

Related U.S. Application Data continuation of application No. 16/723,425, filed on Dec. 20, 2019, now Pat. No. 11,434,902.

(60) Provisional application No. 62/816,732, filed on Mar. 11, 2019.

(51) Int. Cl.

| | |
|---|---|
| ***F04C 2/07*** | (2006.01) |
| ***F04C 11/00*** | (2006.01) |
| *F04B 43/02* | (2006.01) |

(56) References Cited

U.S. PATENT DOCUMENTS

| | | | | |
|---|---|---|---|---|
| 3,003,309 | A | 10/1961 | Bowers | |
| 4,381,179 | A * | 4/1983 | Pareja | F04B 9/045 74/44 |
| 4,430,048 | A | 2/1984 | Fritsch | |
| 5,380,267 | A * | 1/1995 | Boutelle | A61M 60/497 600/18 |
| 5,558,381 | A | 9/1996 | Park | |
| 5,893,318 | A | 4/1999 | Cheng | |
| 5,934,646 | A | 8/1999 | Tamura | |
| 6,832,900 | B2 * | 12/2004 | Leu | F04B 39/0027 417/523 |
| 7,736,132 | B2 * | 6/2010 | Bliss | A61M 16/10 128/205.12 |
| 9,097,249 | B2 | 8/2015 | Petersen | |
| 2004/0177750 | A1 * | 9/2004 | Wiechers | F04B 43/0054 92/98 R |
| 2004/0197201 | A1 * | 10/2004 | Moisidis | F04B 39/0094 417/266 |
| 2005/0123426 | A1 * | 6/2005 | Schaake | B60T 17/02 417/534 |
| 2012/0269664 | A1 | 10/2012 | Ruffer et al. | |
| 2016/0223083 | A1 | 8/2016 | Eaton, Jr. | |
| 2017/0067455 | A1 | 3/2017 | Reukers | |
| 2017/0218943 | A1 | 8/2017 | Ellis et al. | |
| 2017/0298930 | A1 * | 10/2017 | West | F04B 43/04 |

FOREIGN PATENT DOCUMENTS

| | | | |
|---|---|---|---|
| CN | 102656070 | A | 9/2012 |
| CN | 204239208 | U | 4/2015 |
| CN | 107100830 | A | 8/2017 |
| CN | 107304761 | A | 10/2017 |
| CN | 107435623 | A | 12/2017 |
| DE | 837205 | C | 4/1952 |
| DE | 4008459 | A1 | 9/1991 |
| DE | 19640596 | A1 | 4/1998 |
| DE | 102016101479 | A1 | 8/2017 |
| EP | 2871362 | B1 | 6/2016 |
| WO | 2017129295 | A1 | 8/2017 |

OTHER PUBLICATIONS

Extended European Search Report issued for European U.S. Appl. No. 20/161,431, mailed Apr. 21, 2020.

Office Action from China National Intellectual Property Administration for Chinese Application No. 202010161297.5 dated Aug. 28, 2023 with English Summary, 15 pages.

Extended European Search Report for European Application No. 24186672.2 dated Sep. 10, 2024, 10 pages.

Office Action and Search Report from China National Intellectual Property Administration for Chinese Application No. 202411265538.5 dated May 10, 2025 with English language summary of the Office Action, 13 pages.

* cited by examiner

ELECTRIC DIAPHRAGM PUMP WITH OFFSET SLIDER CRANK

CROSS REFERENCE TO RELATED APPLICATIONS

The present application is a continuation of U.S. patent application Ser. No. 17/858,500, filed on Jul. 6, 2022, which is a continuation of U.S. patent application Ser. No. 16/723,425, filed on Dec. 20, 2019, which claims the benefit of U.S. Provisional Patent Application Ser. No. 62/816,732, which was filed on Mar. 11, 2019, and each of these applications is incorporated herein by reference in its entirety.

FIELD OF DISCLOSURE

The present disclosure relates to positive displacement pumps that are utilized to move liquids and slurries. More particularly, but not exclusively, the present disclosure relates to diaphragm pumps having an electric motor that is used to activate one or more diaphragms of the pump.

BACKGROUND

Pumps can be used to facilitate the transfer of fluids, including, but not limited to, liquids, slurries, and mixtures. Thus, pumps, such as, for example, positive displacement pumps, can be designed to handle a range of fluid viscosity, including fluids that include a relatively significant solid content, as well as be designed to pump relatively harsh chemicals.

Positive displacement pumps can take a variety of different forms, including, for example, positive displacement pumps that utilize diaphragms or pistons in connection with the intake, and subsequent discharge, of a fluid from a chamber of the pump. For example, with respect to positive displacement pumps that diaphragm pumps, such pumps often include a pair of opposed diaphragms that reciprocate relative to one another along a common axis. Conventionally, these "double diaphragm" pumps have been pneumatically driven with high-pressure air. Such designs can allow pressures generated by the pump to be controlled by the pressure of the air in the system. Further, because a pneumatic drive can often prevent the generation of sparks, such air-operated diaphragm pumps are often suitable for operation in potentially explosive environments.

However, air operated diaphragm pumps (AODP) do have their drawbacks. For example, the high-pressure air of the AODP is typically generated by an air compressor, which can be an additional piece of equipment, and associated cost, that is needed for the system. Additionally, the reliance upon pneumatics can result in poor net operational energy usage due to the relatively significant losses of energy in the creation, transport, and conversion of high-pressure gas to mechanical work.

Accordingly, there remains an opportunity to create a pump that includes and improves upon the typical benefits of diaphragm pumps, while providing an alternative to reliance upon the inefficiencies of pneumatically driven pumps.

BRIEF SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

An aspect of an embodiment of the present disclosure is a diaphragm pump that can include a crankcase and a crankshaft, the crankshaft being at least partially positioned within the crankcase and rotatable about a rotational axis. The diaphragm pump can include a piston that is coupled to the crankshaft by a connecting rod, the piston being reciprocally displaceable within a piston cylinder and along an axis of motion between a suction stroke and a discharge stroke, the axis of motion intersecting a connection between the piston and the connecting rod. A diaphragm housing can be coupled to an end of the piston cylinder, and can be configured to at least partially define a pumping chamber and pump fluid through the pumping chamber as the piston reciprocates. The axis of motion may not intersect the rotational axis of the crankshaft such that, relative to an arrangement in which the axis of motion does intersect the rotational axis, a peak magnitude of piston side load forces encountered during the discharge stroke is reduced and a peak magnitude of piston side load forces encountered during the suction stroke is increased to attain a closer balance between the peak magnitudes of the piston side load forces of the discharge stroke and the suction stroke.

Another aspect of an embodiment of the present disclosure is a diaphragm pump system that can include a crankcase, and a crankshaft that is at least partially positioned within the crankcase and coupled to the electric motor. Further, the crankshaft can be rotatable about a rotational axis. At least three pistons can be radially arranged around the crankcase, each piston of the at least three pistons being coupled to a throw of the crankshaft by a connecting rod. Additionally, each piston can be reciprocally displaceable within a piston cylinder and along an axis of motion between a suction stroke and a discharge stroke, the axis of motion for each piston of the at least three pistons intersects a connection between the piston and the connecting rod. The diaphragm pump system can also include at least three diaphragm housings that are each coupled to an end of a piston cylinder and configured to at least partially define a pumping chamber and pump fluid through the pumping chamber as the piston reciprocates. Further, the axis of motion of each of the at least three pistons may not intersect the rotational axis of the crankshaft such that a peak magnitude of piston side load forces encountered during the discharge stroke are reduced and a peak magnitude of piston side load forces encountered during the suction stroke is increased such that, relative to an arrangement in which the axes of motion do intersect the rotational axis, a closer balance is attained between the piston side load forces of the discharge stroke and the suction stroke.

Additionally, as aspect of an embodiment of the present disclosure is a diaphragm pump that can include a crankcase and a crankshaft, the crankshaft being at least partially positioned within the crankcase and rotatable about a rotational axis. The diaphragm pump can include a piston that is coupled to the crankshaft by a connecting rod, the piston being reciprocally displaceable within a piston cylinder between a suction stroke and a discharge stroke. A diaphragm housing can be coupled to an end of the piston cylinder, and can be configured to at least partially define a pumping chamber and pump fluid through the pumping chamber as the piston reciprocates. The piston cylinder can extend about a central longitudinal cylinder axis that intersects the rotational axis. Additionally, the piston can be pivotally coupled to the connecting rod by a wrist pin that is positioned along a central longitudinal axis of the wrist pin that is parallel to, linearly offset from, the central longitudinal cylinder axis such that, relative to an arrangement in which the wrist pin is not linearly offset from the central longitudinal cylinder axis, a peak magnitude of piston side load forces encountered during the discharge stroke is reduced and a peak magnitude of piston side load forces encountered during the suction stroke is increased so as to attain a closer balance between the piston side load forces of the discharge stroke and the suction stroke.

These and other aspects of the present disclosure will be better understood in view of the drawings and following detailed description.

BRIEF DESCRIPTION OF THE DRAWINGS

The description herein makes reference to the accompanying figures wherein like reference numerals refer to like parts throughout the several views.

Figure 1:
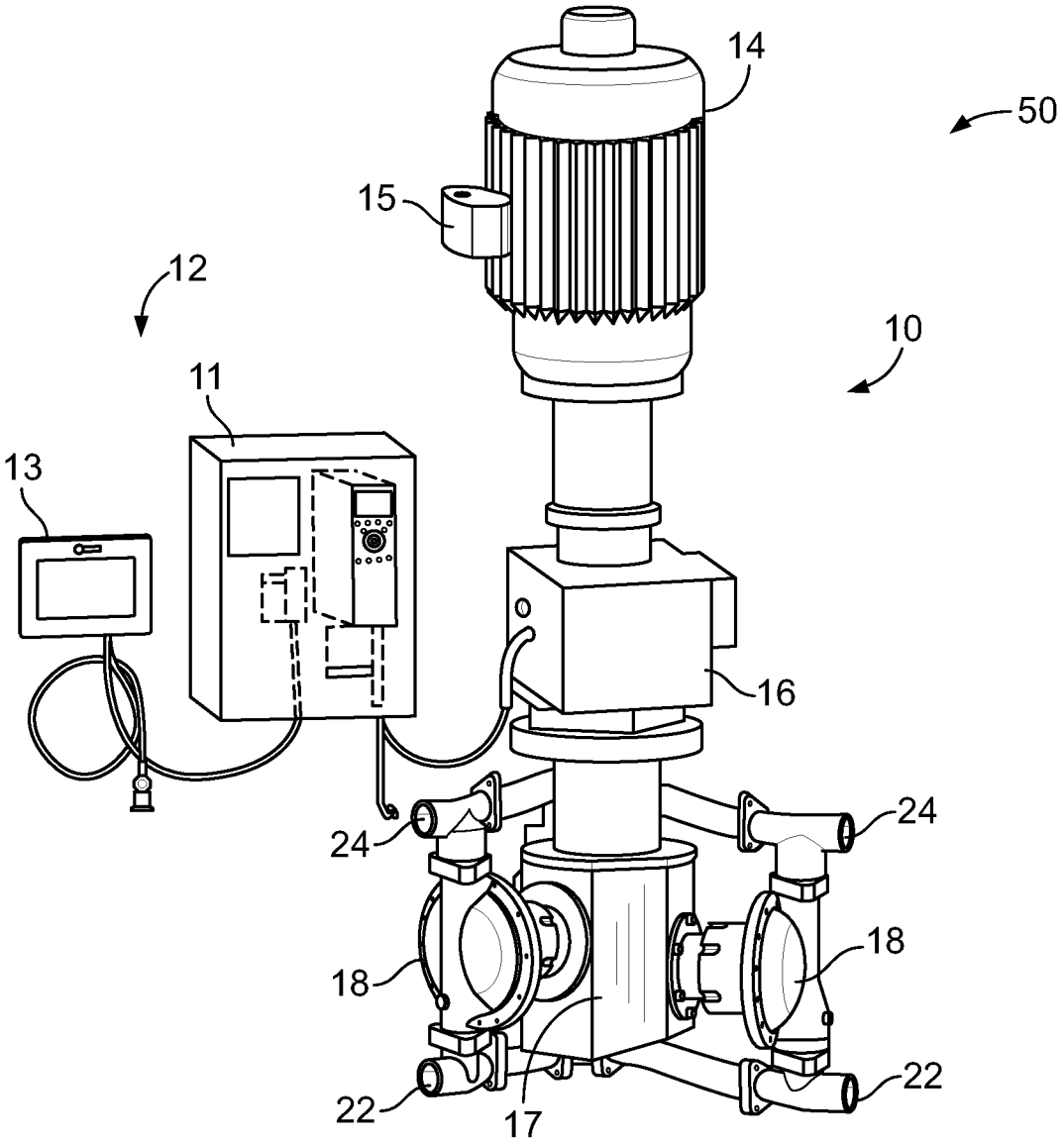
FIG. 1 illustrates a diaphragm pump system according to an illustrated embodiment of the present disclosure.

The foregoing summary, as well as the following detailed description of certain embodiments of the present disclosure, will be better understood when read in conjunction with the appended drawings. For the purpose of illustrating the disclosure, there is shown in the drawings, certain embodiments. It should be understood, however, that the present disclosure is not limited to the arrangements and instrumentalities shown in the attached drawings. Further, like numbers in the respective figures indicate like or comparable parts.

DESCRIPTION OF THE ILLUSTRATED EMBODIMENTS

Certain terminology is used in the foregoing description for convenience and is not intended to be limiting. Words such as "upper," "lower," "top," "bottom," "first," and "second" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIG. 1 illustrates a diaphragm pump system 50 according to an illustrated embodiment of the present disclosure. The diaphragm pump system 50 can include, among other components, a diaphragm pump 10 that is operably coupled to a control system 12 and a driver 14. While embodiments discussed herein are discussed in terms of diaphragm pump systems, including electric diaphragm pump systems, at least certain features can also be applicable to a variety of other types of pump systems, including, but not limited to, other types of pumps and positive displacement pumps, including, but not limited to, positive displacement pumps that utilize pistons rather than diaphragms for displacement of fluids into/from a pumping chamber of the pump. Additionally, at least certain features of the diaphragm pump systems discussed herein can provide relatively significant advantages when compared to at least pneumatic diaphragm pump systems, including, but not limited to, increased energy efficiency in net operational energy usage.

According to certain embodiments, the control system 12 can include, for example, an external embedded controller 11 that is communicatively coupled to a human-machine interface 13, among other components. The external controller 11 can be configured to automate the operation of the diaphragm pump 10 for at least purposes of batching or dosing. The external controller 11 can also be configured to add other cycle counting functionality for the system 50. Additionally, the external controller 11 can be configured to correlate speed of a driver 14, such as, for example, a motor speed, with a flow rate of a process fluid being pumped by the diaphragm pump. The external controller 11 can also include an override for extended periods of a stall event. Further, the control system 12 may be optional to supplement a motor drive, such as a variable frequency drive (VFD) 15 that is configured to operate the driver 14.

Figure 4:
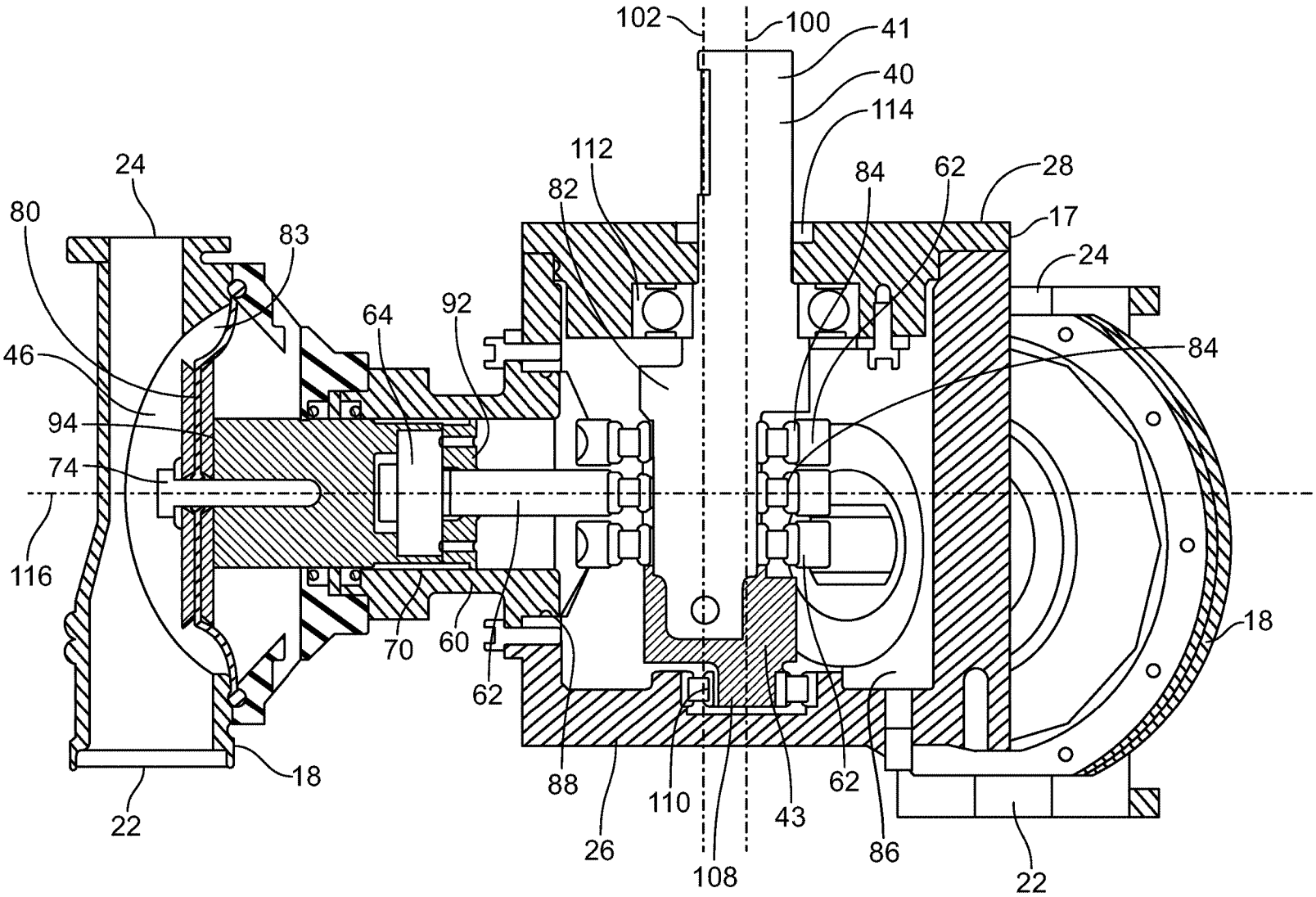
FIG. 4 illustrates a cross-sectional view of the diaphragm pump taken along line 4-4 in FIG. 2.

As shown in at least FIG. 1, the diaphragm pump 10 can be mechanically coupled to the driver 14. While a variety of types of drivers 14 can be utilized, including, but not limited to, a variety of different types of engines and motors, according to the illustrated embodiment, the driver 14 is an electric motor. Additionally, the driver 14 can be operably coupled to a crankshaft 40 (FIG. 4) of the diaphragm pump system 50 such that operation of the driver 14 can facilitate rotational displacement of at least the crankshaft 40 about a crankshaft axis (or "rotational axis") 100 (FIG. 4). Further, as shown in at least FIG. 1, according to certain embodiments, such operable coupling of the driver 14 to the crankshaft 40 can include a gearbox 16 that can be configured to adjust and/or control the relative speeds and torque transmitted from the driver 14 to the crankshaft 40.

As shown in at least FIGS. 1-5, according to certain embodiments, the diaphragm pump 10 can include a crankcase 17, a plurality of diaphragm housings 18, a common inlet manifold 20 (FIG. 5), a common outlet manifold 38, and a slider crank mechanism 21 (FIG. 3), among other components. Further, as shown by at least FIG. 2, the crankcase 17 can include a lower crankcase 26 and an upper crankcase 28. As shown in at least FIG. 4, the lower crankcase 26 can provide a lower crankcase cavity 86. Additionally, the crankshaft 40 can protrude from the crankcase 17 for operable connection with the driver 14, as previously discussed.

While the number of diaphragm housings 18 can vary for different embodiments, the inventors of the subject disclosure have determined that an odd number of diaphragm housings, greater than one, may be preferred. Thus, the illustrated embodiment depicts, but is not limited to, a diaphragm pump 10 having three diaphragm assemblies 18. Further, each diaphragm housing 18 can be coupled to an adjacent piston 68 of the slider crank mechanism 21, as shown, for example, in FIG. 3. In addition to a plurality of pistons 68, which are each reciprocally displaceable within a corresponding piston cylinder 60, the illustrated slider crank mechanism 21 can also include a cam 82 of the crankshaft 40, which can also referred to as a throw, and a connecting rod 62, as shown, for example, in FIG. 4.

Additionally, according to at least certain embodiments, each of the diaphragm housings 18 can have generally similar components. Similarly, at least certain components of the slider crank mechanism 21 that are associated with a particular diaphragm housing 18 can have the same configuration as other similar components of the slider crank mechanism 21 that are associated with another diaphragm housing 18. Thus, for example, each of piston 68, piston cylinder 60, and/or connecting rod 62 of the slider crank mechanism 21 that is used with a particular diaphragm housing 18 can have similar configuration and features as a similar component that is used with another diaphragm housing 18. Accordingly, it should be understood that, unless indicated otherwise, parallel elements and associated features for those elements can exist for each of the diaphragm assemblies 18 and the associated the slider crank mechanisms 21, whether or not such parallel elements and features are actually viewable in certain Figures of this disclosure or explicitly individually discussed herein.

Each diaphragm housing 18 can comprise an outer housing 42, which can also be referred to as a fluid cap, and an inner housing 44. As shown in at least FIG. 3, at least an inner portion of the outer housing 42 can generally define at least a portion of a pumping chamber 46 of the diaphragm housing 18. The pumping chamber 46 can be in fluid communication with an inlet 22 and an outlet 24 of the diaphragm housing 18. Thus, according to the illustrated embodiment, at least a portion of a process fluid that enters the common inlet manifold 20 of the diaphragm pump 10 can enter the pumping chamber 46 of the diaphragm housing 18 through the inlet 22. Further, such process fluid can exit the pumping chamber 46 through the outlet 24 of the diaphragm housing 18, and proceed on to the common outlet manifold 38 of the diaphragm pump 10.

Figure 5:
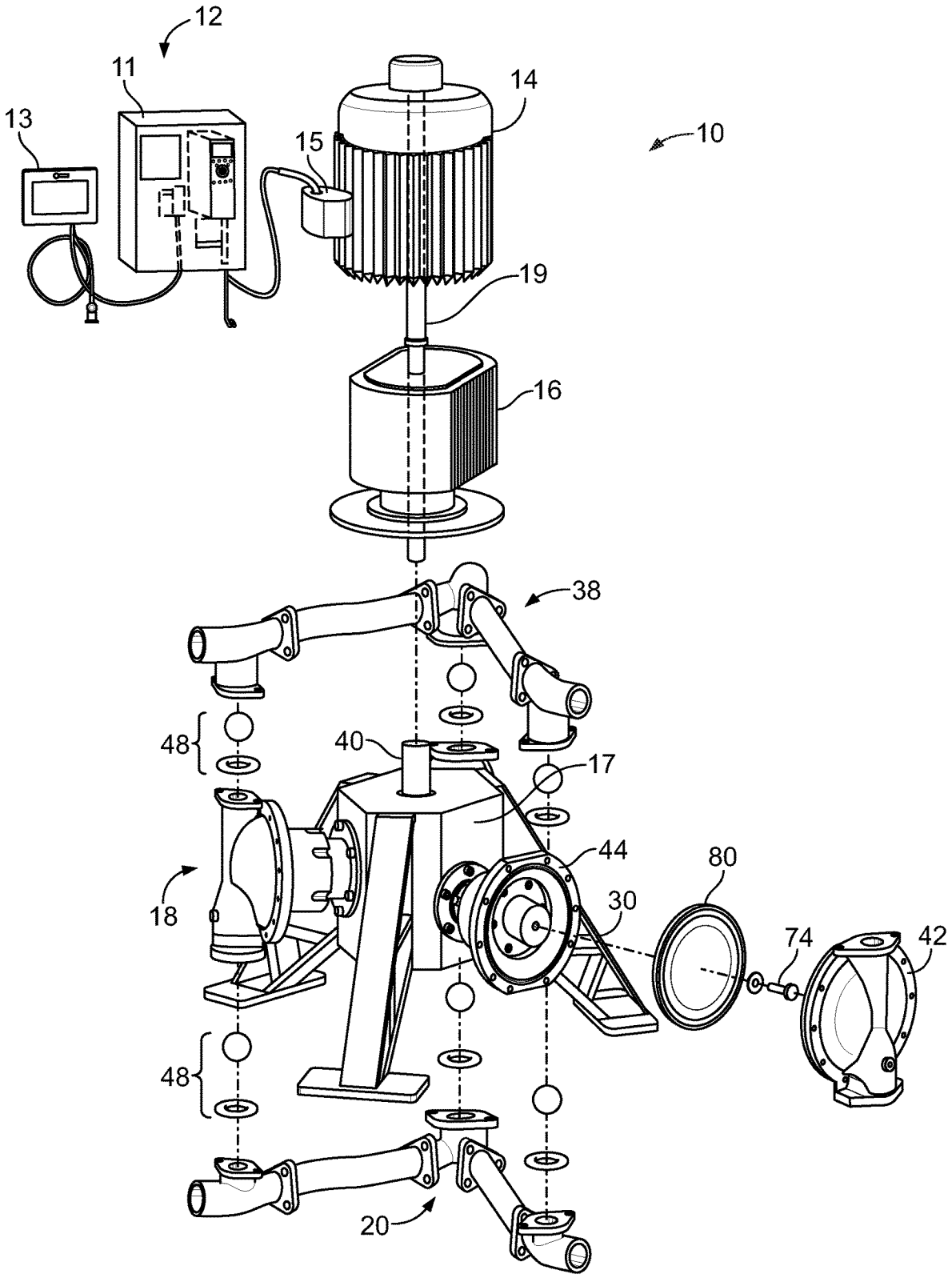
FIG. 5 illustrates an exploded view of a diaphragm pump system and an associated stand according to an illustrated embodiment of the present disclosure.

Additionally, as shown in FIG. 5, according to certain embodiments, one-way check valves 48 can be functionally positioned proximate to both the inlet 22 and the outlet 24 of each of the diaphragm housings 18. While a variety of types of one-way check valves can be utilized, according to certain embodiments, the one-way check valves 48 are ball valves. Additionally, according to certain embodiments, such ball valves can be gravity operated, and thus not include biasing mechanisms, such as, for example, springs. However, alternatively, according to other embodiments, the one-way check valves 48 can include a biasing element such as, for example, a spring, among other forms of biasing elements.

Figure 2:
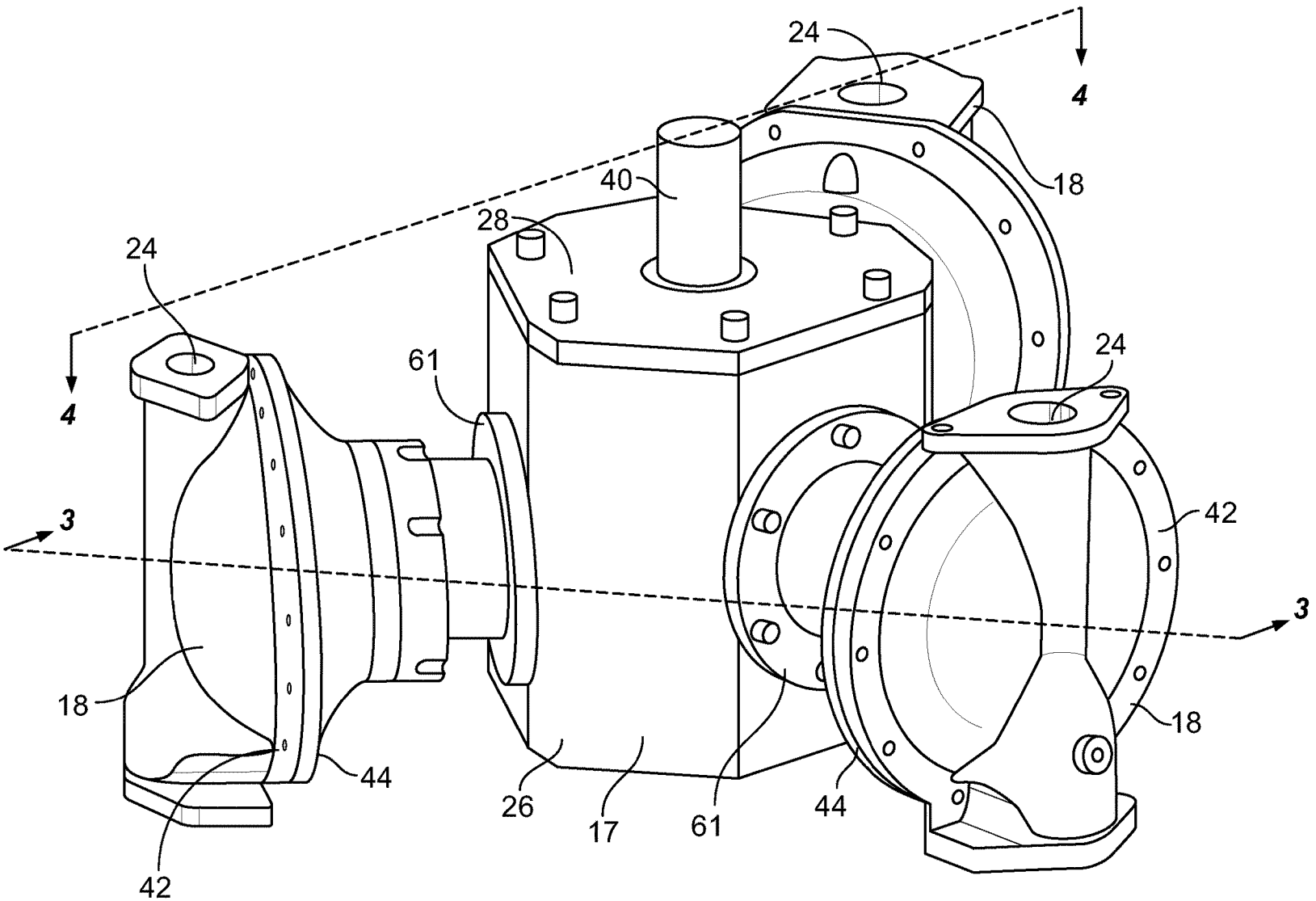
FIG. 2 illustrates a perspective side view of a diaphragm pump according to an illustrated embodiment of the present disclosure.
Figure 3:
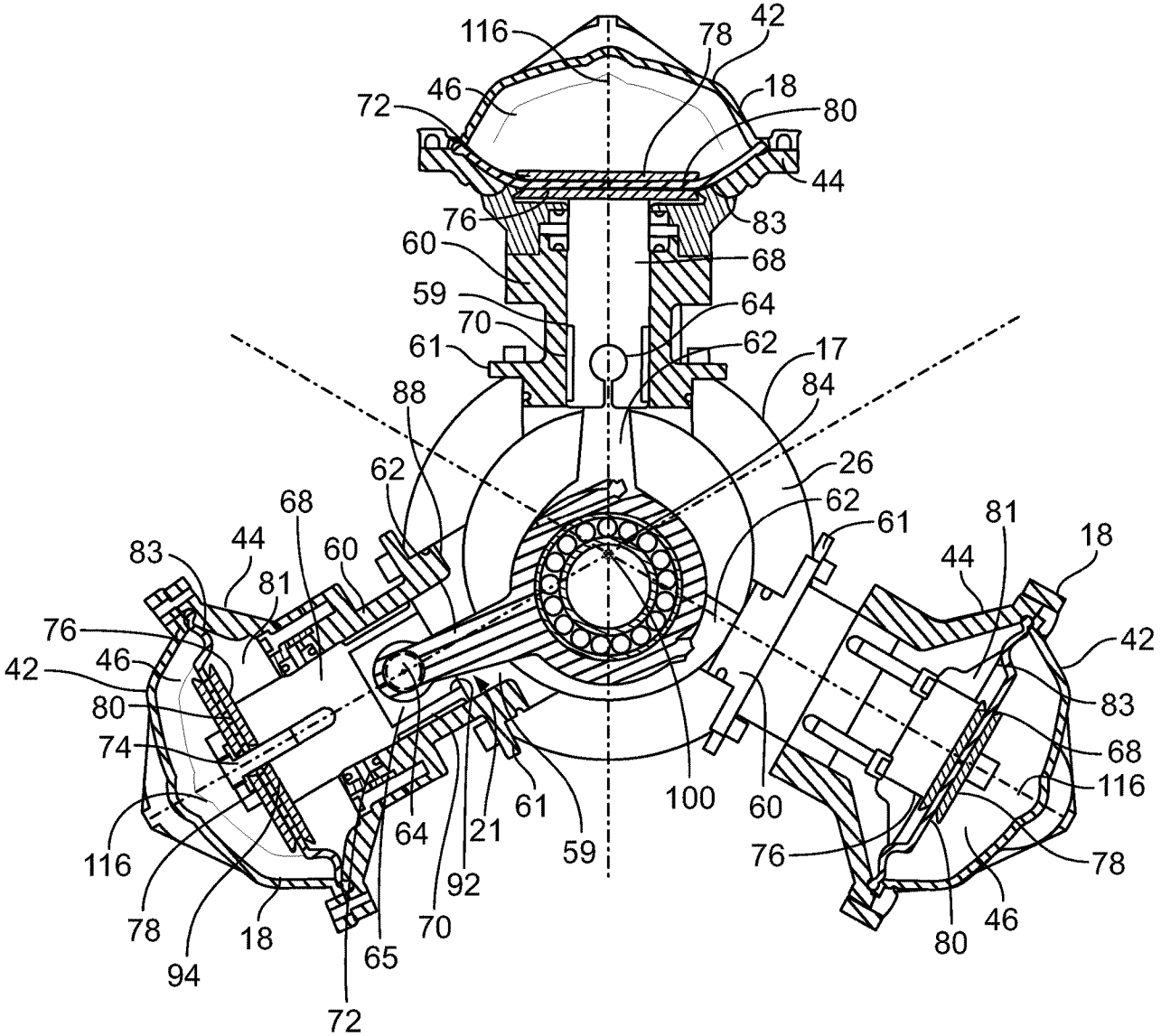
FIG. 3 illustrates a cross-sectional view of the diaphragm pump taken along line 3-3 in FIG. 2.

FIG. 3 illustrates a cross-sectional view that is taken along line 3-3 in FIG. 2. The diaphragm housing 18 includes a diaphragm 80 that can be utilized to change a volume, and thus a pressure, within the pumping chamber 46. Operation of the diaphragm 80 can be utilized to draw process fluid into the pumping chamber 46 through the inlet 22, such as, for example, via displacing or flexing at least a portion of the diaphragm 80 in a first direction to increase a volume, and thereby decrease a pressure, within the pumping chamber 46. Further, displacement or flexing of the diaphragm 80 in a second, opposite direction, can decrease the volume of the pumping chamber 46, and thereby provide a pressure that can force at least a portion of the process fluid out from the pumping chamber 46 through the outlet 24.

While a variety of types of diaphragms can be utilized, according to certain embodiments, the diaphragm 80 is a traditional flexible diaphragm. Additionally, and optionally, according to certain embodiments, the diaphragm 80 can, compared to the use of a diaphragm in a conventional AODP, be positioned in a reverse orientation between the inner housing 44 and the outer housing 42. According to certain embodiments, such as that shown in at least FIGS. 3 and 4, the diaphragm 80 can be positioned such that an arcuate shape of an annular flexible portion 83 of the diaphragm 80 is disposed in a direction generally away from pumping chamber 46 and, instead, towards the general direction of a containment cavity 81 of the diaphragm housing 18.

The diaphragm 80 within the diaphragm housing 18 can be designed as a replaceable wear component. For example, in the illustrated embodiment, the diaphragm 80 is mechanically coupled to a second end 94 of an associated piston 68 via a removable mechanical fastener 74, such as, for example, a bolt. Further, according to certain embodiments, the mechanical fastener 74 can extend through an inner washer 76 and an outer washer 78 that are positioned on, and support, opposing sides of the diaphragm 80. For example, as shown in at least FIG. 3, the radially inner portion of diaphragm 80 can be secured between the inner washer 76 and the outer washer 78. The inner and outer washers 76, 78 can be configured to provide stabilizing and rigid support to at least the adjacent portion of the diaphragm 80. Additionally, the radially outward portion of the diaphragm 80 can be securely fitted between opposing sealing surfaces of the inner housing 44 and the outer housing 42. Further, according to certain embodiments, the outer washer 78 can be integrated into the diaphragm 80, such that the outer washer 78 and diaphragm 80 together have a monolithic structure.

Further, as discussed below, the diaphragm housing 18 can be configured to minimize or avoid contamination of process fluid that may leak past the diaphragm 80, such as, for example, leak past the diaphragm 80 as a result of the diaphragm 80 being damaged or worn. Such minimization or prevention of leakage past the diaphragm 80 can also minimize the disruption in the operation of, and/or damage to, the diaphragm 80, and thus the diaphragm pump 10. Additionally, the diaphragm pump 10 can similarly be designed to minimize or avoid contamination of the process fluid that may have leaked through the diaphragm 80.

More specifically, as can be seen in at least FIG. 3, during a discharge stroke in which the diaphragm 80 is forced axially away from the rotational axis 100, process fluid can be pumped from the pumping chamber 46 as the volume of the pumping chamber 46 is decreased. In the event that the diaphragm 80 is damaged, and/or the diaphragm 80 fails, the pressure created on the pumped fluid side of the diaphragm 80 during the discharge stroke can tend to force at least a portion of the process fluid to flow past, or behind, the diaphragm 80. However, in the illustrated embodiment, a containment cavity 81 can be defined on the backside of the diaphragm 80. During normal operation, the containment cavity 81 can include low-pressure air, such as, for example, air that is around ambient pressure, including, for example, without about 10 pounds per square inch (psi) of ambient air pressure, as measured when the diaphragm pump 10 is not operating. This low-pressure air can be passed among the containment cavities 81 of the separate diaphragm housings 18. Because each diaphragm 80 is in a different phase of its stroke at any one time, significant pressure is not built up in the containment cavities 81.

Additionally, prior art diaphragm pumps often use a high-pressure working fluid, such as a hydraulic fluid, that is stored behind a diaphragm to apply fluid pressure on the backside of the diaphragm that assists, or entirely drives, the diaphragm. However, with such designs, a leak through a diaphragm can cause the working fluid to flow from the backside of the diaphragm and into the process fluid, thereby contaminating the process fluid. Yet, unlike such designs, the containment cavity 81 of the diaphragm housing 18 disclosed herein may contain only low-pressure air because the diaphragm 80 is substantially entirely mechanically actuated, such as for example, by a corresponding piston 68, and the components associated with the mechanical coupling of the piston 68 to the diaphragm 80. Thus, according to certain embodiments of the subject disclosure, unlike prior designs that at least partially, if not entirely, relied on high-pressure working fluid to drive the diaphragm, the annular flexible portion 83 of the diaphragm 80 is not driven by a working fluid, but instead can generally be entirely mechanically actuated.

The containment cavity 81 can also be substantially sealed from a lubricant bath that can be within at least a portion of the crankcase 17, such as, for example, lubricant that is within the crankcase cavity 86 that is utilized to reduce wear and distribute heat of the crankshaft 40 and the connecting rods 62. For example, a seal assembly 72 (FIG. 3) can bear against the outer surface of the piston 68. The seal assembly 72 can include, for example, one or more oil facing seals and one or more containment cavity facing seals, including, but not limited to bellows seals and bi-directional seals. According to certain embodiments, the cavity facing seal can be a bellow design (not shown) that spans between a second end 94 of the piston 68 and the piston cylinder 60. The seal assembly 72 can be configured and positioned to prevent lubricant from mixing with process fluid, even in the event process fluid were to leak past the diaphragm 80 and reach the containment cavity 81.

Additionally, during at least maintenance operations, the containment cavity 81 can confine the process fluid to minimize downtime of the diaphragm pump 10. For example, by simple removal of the outer housing 42 and the mechanical fastener 74 of the diaphragm housing 18, as shown in at least FIG. 4, the diaphragm 80 and inner and outer washers 76, 78 can be removed, and the containment cavity 81 can readily, and completely, be cleaned out.

With respect to operation of the slider crank mechanism 21, the piston 68 reciprocates along a piston axis that extends through a cylinder bore 59 of a piston cylinder 60 that is positioned between the crankcase 17 and the diaphragm housing 18. The piston 68 extends between a first end 92 and a second end 94 of the piston 68. The portion of piston 68 proximate the crankcase 17, namely the first end 92 of the piston 68, can include a wrist pin cavity in which a wrist pin 64 is positioned that attaches the piston 68 to connecting rod 62.

The piston cylinder 60 can be removably mounted to the lower crankcase 26. As shown in at least FIGS. 3 and 4, according to certain embodiments, the piston cylinder 60 can be in alignment with an aperture 88 of the lower crankcase 26 such that a portion of the piston cylinder 60 extends through the aperture 88 and towards the crankcase cavity 86. The piston cylinder 60 can also be mated to internal surfaces of the aperture 88. Such an arrangement can provide increased stability for piston cylinder 60 during operations of the pump 10. Additionally, such a configuration can reduce the radial dimensions of pump 10 via such positioning of the piston cylinder 60 and, consequently, the piston 68, diaphragm 80, and outer housing 42 can be at a reduced radial position(s) from the crankshaft 40. Additionally, as shown in at least FIG. 8, the piston cylinder 60 can also further comprise a shoulder 61 that can be attached to a planar surface 138 of the crankcase 17, thereby providing increased stability for the piston cylinder 60 during operation of the pump 10 and improve the ease of access and disassembly.

According to certain embodiments, the piston 68 and piston cylinder 60 can be designed for controlled metal-to-metal sliding contact. Further, one or both of the piston 68 and the piston cylinder 60 can be surface treated, such as with a diamond coating, so as to control wear of one or both of the piston 68 and the piston cylinder 60. In other embodiments, a rolling contact can be provided between the piston 68 and the piston cylinder 60, such as, for example, via a rolling element bearing that is a recirculating ball track that is running against a rail.

Additionally, or alternatively, a sleeve or rider band 70 (FIG. 7) can be positioned circumferentially around a portion of the piston **6*a* that can minimize or prevent metal-to-metal contact between the piston 68 and an adjacent portion of the piston cylinder 60. The sleeve 70, which can be replaceable as a wear part, can be made from a variety of materials, including, for example, polymers, ceramics, or metals. Example polymers that may provide suitable wear properties across the necessary pressure and velocity ranges of the piston 68** can include Torlon®, polyester reinforced resin, and bronze filled polytetrafluoroethylene (PTFE), among other materials.

Figure 7:
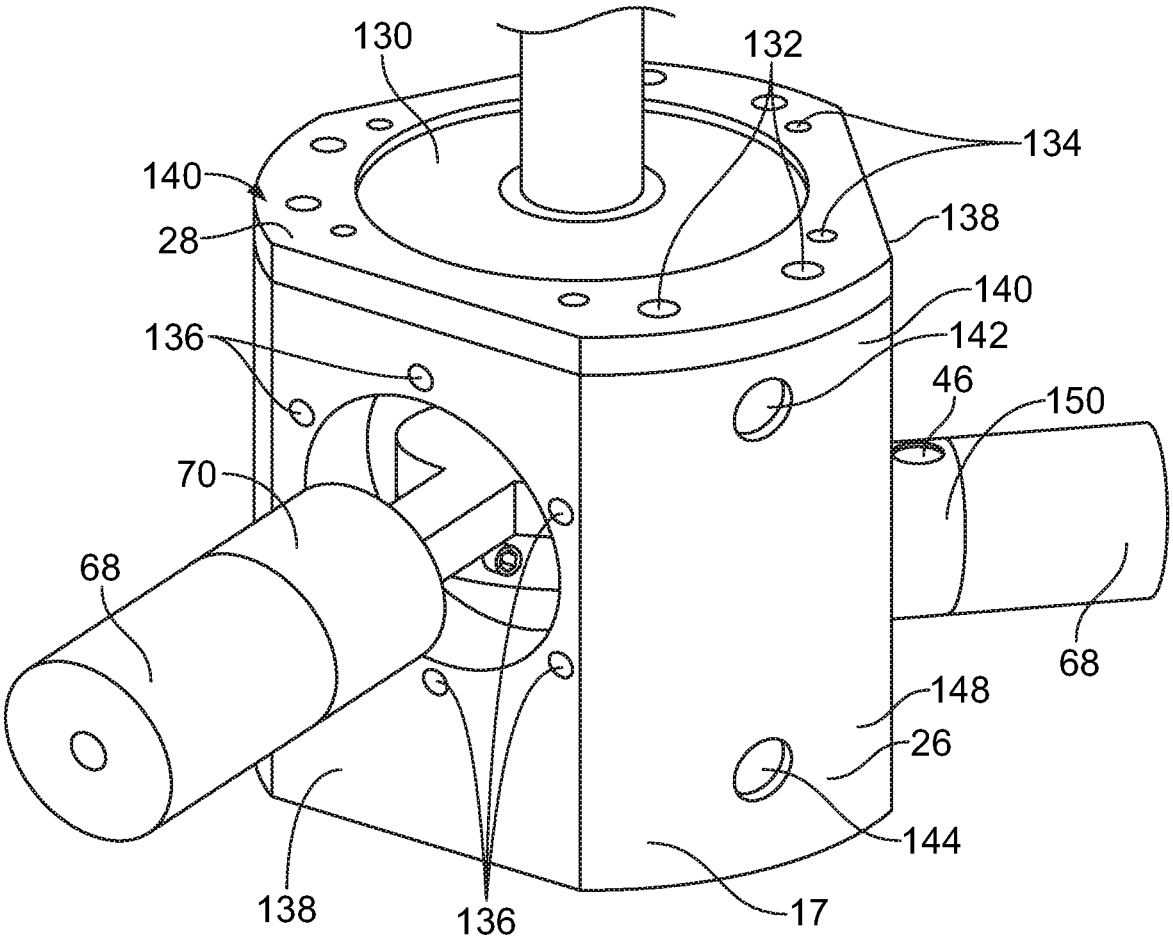
FIG. 7 illustrates a side perspective view of a crankcase and piston components of a diaphragm pump according to an illustrated embodiment of the present disclosure.

For example, FIG. 7 illustrates, among other features, a sleeve 70 attached to a first piston 68, and another, second piston 68 prior to attachment of a sleeve to the piston 68. With respect to the second piston 68, as seen, an outer surface of the piston 68 includes a sleeve recess 150 formed into the piston 68 that is configured for seating of a sleeve onto the piston 68. As also seen, according to certain embodiments, the sleeve recess 150 can be a portion of the outer surface of the piston 68 having a size, such as, for example, a diameter, that is different, such as, for example, smaller, than a corresponding size of other, adjacent portions of the piston 68. Additionally, while the sleeve recess 150 can be positioned at a variety of locations along the piston 68, as shown in FIG. 7, according to certain embodiments, the sleeve recess 150 can be at a location at which, then sleeve 70 is attached to the piston 6*b*, the sleeve 70 will cover a wrist pin 64 that attaches the piston 68 to the associated connecting rod.

As previously discussed, and as shown in at least FIG. 4, the crankshaft 40 can rotate about a rotational axis 100. Similarly, the cam 82, which is offset relative to the crankshaft 40, includes central axis 102 that can be parallel, and offset, to the rotational axis 100. According to certain embodiments, the crankshaft 40 can comprise a two-part shaft. Moreover, the cam 82 may be integral with a first portion 41 of the crankshaft 40, while a second portion 43 of the crankshaft 40 may form a seat 108. The seat 108 can be secured in the lower crankcase 26 by a first bearing set 110, and a second bearing set 112 can secure the crankshaft 40 in the upper crankcase 28. Additionally, the upper crankcase 28 can include a seal 114 that extends around a portion of the crankshaft 40.

As partially shown in FIG. 4, the connecting rod 62 can extend from the connection with the piston 68, as previously discussed, to a connection with the cam 82 of the crankshaft 40. While the connecting rod 62 can be connected to the cam 82 in a variety of different manners, according to the illustrated embodiment, the connecting rod 62 is connected to the cam 82 by a bearing ring or journal bearing 84. While the bearing ring 84 can be coupled to the connecting rod 62 in a variety of manners, as shown by at least FIG. 4, according to the illustrated embodiment the bearing ring 84 can be positioned within an aperture in the connecting rod 62. The bearing ring 84 can also be configured to facilitate a sliding motion between the connecting rod 62 and the cam 82 of the crankshaft 40. Additionally, according to the illustrated embodiment, each bearing ring 84 can be vertically displaced relative to one another along the cam 82, as well as centered on the central axis 102 of the cam 82.

As shown in at least FIGS. 3 and 4, extending through each piston cylinder 60 is a corresponding central longitudinal cylinder axis 116. Additionally, according to certain embodiments, each piston 68 shares its central axis with its corresponding cylinder axis 116. Further, according to certain embodiments, the wrist pin 64 can also be positioned on the cylinder axis 116. Alternatively, according to other embodiments, the wrist pin 64 can be linearly offset from the cylinder axis 116, which can provide the slider crank mechanism 21 with offset features that can improve the balance of piston side load forces and stresses that can be encountered during discharge and suction strokes of the diaphragm housings 18, as discussed below.

As also partially shown FIGS. 3 and 4, the diaphragm housing 18 can similarly be oriented about the cylinder axis 116 of the associated piston cylinder 60. Additionally, the bearing ring 84, the connecting rod 62, piston cylinder 60, and piston 68 can be centered on a horizontal plane that, which, along with similar horizontal planes for the other diaphragm housings 18, can be vertically displaced along the cam 82.

Additionally, according to certain embodiments, each cylinder axis 116 for the diaphragm housings 18 are perpendicular to the rotational axis 100 of the crankshaft 40. Further, the cylinder axes 116 of the diaphragm housings 18 can, according to certain embodiments, also be substantially equally radially spaced around the rotational axis 100. For example, with respect to FIG. 3, according to certain embodiments in which the diaphragm pump 10 comprises three diaphragm housings 18, each cylinder axis 116 is disposed 120 degrees from each other cylinder axis 116. Because all three connecting rods 62 of the diaphragm housings 18 are disposed on the same cam 82, and equally spaced around the rotational axis 100, the reciprocations of respective pistons 68 are mutually out of phase 120 degrees. Thus, if a piston 68 of a first diaphragm housing 18 is at 0 degrees in its reciprocation cycle, a piston 68 of a second diaphragm housing 18 is at 120 degrees of its respective reciprocation cycle, and a piston 68 of a third diaphragm housing 18 is at 240 degrees of its respective reciprocation cycle. Similarly, for certain embodiments that include five diaphragm housings, each piston can be disposed approximately 72 degrees from its adjacent piston.

FIG. 5 illustrates an exploded view of an exemplary diaphragm pump 10 and an associated stand 30 according to an illustrated embodiment of the present disclosure. As shown in the embodiment depicted in FIG. 5, the diaphragm pump 10 can include the driver 14 and gear box 16 being in a vertical orientation relative to the crankcase 17 and stand 30, with the drive shaft 19 of the driver 14 being oriented to coaxially couple, directly or indirectly, with crankshaft 40. Also shown in FIG. 5 are exploded views of the diaphragm housings 18, which, as previously mentioned, can each include at least an outer housing 42, an inner housing 44, a diaphragm 80, and a mechanical fastener 74. Also shown are a common inlet manifold 20 and a common outlet manifold 38, as well as one-way check valves 48 that are in operable communication with the common inlet manifold 20 and common outlet manifold 38, respectively. Additionally, FIG. 5 illustrates a three-legged stand 30, with individual legs of the stand 30 being disposed about the crankcase 17 at locations between adjacent diaphragm housings 18. Such legs of the stand 30 can secure pump 10 on a horizontal work surface with a minimal work surface footprint.

Figure 6:
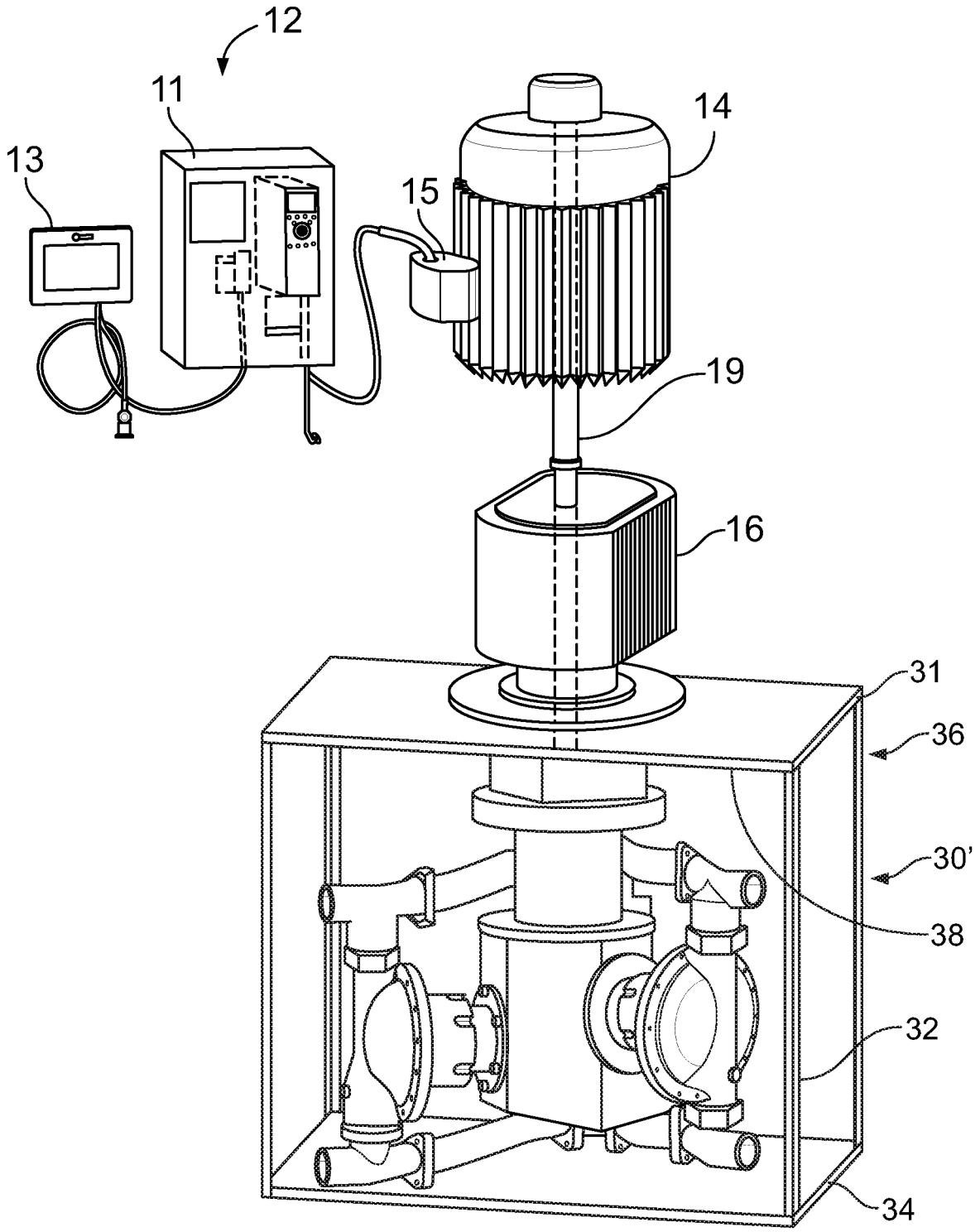
FIG. 6 illustrates a side view of a diaphragm pump system and an associated stand according to an illustrated embodiment of the present disclosure.

FIG. 6 illustrates a side view of a diaphragm pump 10 mounted to an alternative stand 30' in accordance with at least one embodiment of the subject disclosure. The stand 30' depicted in FIG. 6 differs from the stand 30 of FIG. 5, and can comprise an upper stand portion 31, a lower stand portion 32, a stand base 34, and a plurality of supports 36. The diaphragm pump 10 can be attached to stand 30' at the upper portion stand portion 31, and/or at the lower stand portion 32. The stand base 34 can serve to secure the diaphragm pump 10 to a work surface or floor, among other surfaces. Additionally, the stand base 34 can be configured for relatively easily picked up, and moving, by a forklift or other trolley.

As indicated by at least FIGS. 5 and 6, the diaphragm pump 10 can be configured to be supported in a substantially vertical orientation by the stand 30, 30'. Thus, the rotational axis 100 (FIG. 5) of the crankshaft 40, as well as a drive shaft 19 of the driver 14, can also be disposed in a generally vertical direction. Further, such orientations can accommodate the drive shaft 19 of the driver 14 being substantially co-axial with the rotational axis 100 of the crankshaft 40.

Such a vertical orientation of the diaphragm pump 10 can provide numerous advantages, including, for example, a significantly reduced workplace footprint, and horizontal access to the pump 10 that may be relatively free of other pump equipment, which can be beneficial to the ability to perform maintenance on the pump 10, including, replacement, servicing and/or cleaning of the pump 10 and/or the components of the pump 10. Additionally, such a vertical orientation of the diaphragm pump 10 can permit one-way check valves 48 to operate based on gravity, which can potentially reduce the number of components of the check valves 48, including, for, example, avoiding springs to bias the balls within the check valves 48. However, while the driver 14 depicted in FIGS. 1, 5, and 6 is shown as being mounted in a vertical orientation, the driver 14, as well as other components of the diaphragm pump system 50, can be mounted in a variety of other orientations.

FIG. 7 illustrates a side perspective view of a crankcase 17 and pistons 68 of a diaphragm pump 10 according to an illustrated embodiment of the present disclosure. Moreover, FIG. 7 depicts at least the lower crankcase 26 and the upper crankcase 28, with two of the pistons 68 protruding therefrom being viewable.

As seen in FIG. 7, according to the illustrated embodiment, the upper crankcase 28 can include a recessed section 130, as well as a plurality of first sets of connector holes 132 for connecting portions of the upper crankcase 28 to the lower crankcase 26 at locations proximate to curved surfaces 140 of the crankcase 17. The upper crankcase 28 can also include a plurality of second sets of connector holes 134 for connecting portions of the upper crankcase 28 to the lower crankcase 26 at locations proximate to planar surfaces 138 of the crankcase 17. The lower crankcase 26 can include a third set of connector holes 136 for connecting the shoulder 61 of the piston cylinder 60 to an adjacent planar surface 138 of crankcase 17. Additionally, the lower crankcase 26 can also include an exterior wall 148, planar surfaces 138, curved surfaces 140, a first circulation port 142, and a second circulation port 144.

Figure 8:
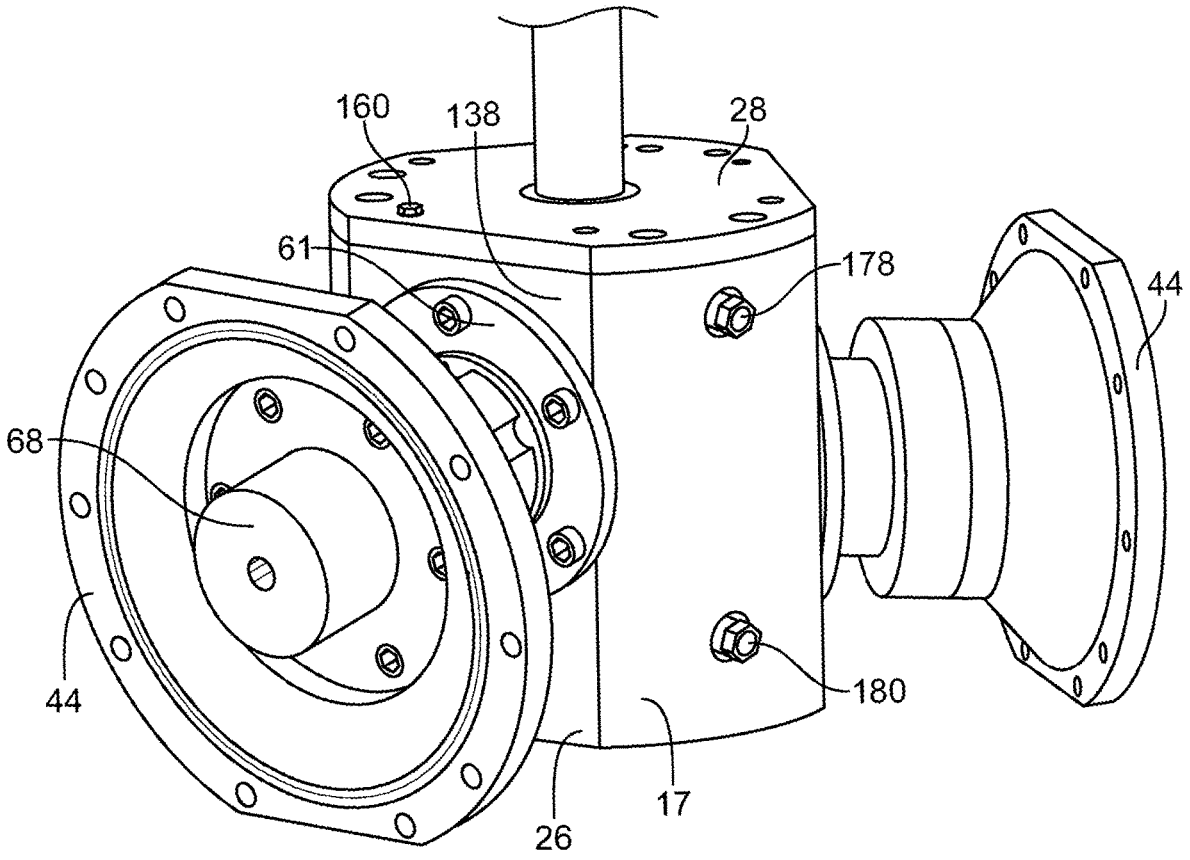
FIG. 8 illustrates a side view of a crankcase, inner diaphragm housings, and certain piston components of a diaphragm pump according to an illustrated embodiment of the present disclosure.

As seen in FIG. 8, connectors 160 can be positioned in at least the second sets of connector holes 134 (FIG. 7) that are used for connecting the upper crankcase 28 to the lower crankcase 26 at locations proximate to the planar surfaces 138 of crankcase 17. Additionally, a first circulation fitting 178 can be secured in the first circulation port 142 (FIG. 7), and a second circulation fitting 180 can be secured in the second circulation port 144 (FIG. 7).

Having described the structure of the diaphragm pump 10, the operation will now be further described. In one exemplary embodiment, the driver 14 is an electric motor that is driven by a current, which, for example, can be controlled by the control system 12. In response to receiving current, the driver 14 can facilitate rotation of a drive shaft 19, which is operably connected to the crankshaft 40, with or without the optional gearbox 16. Due to the offset between the rotational axis 100 and the central axis 102 of the cam 82, rotation of the crankshaft 40 will generate reciprocating axial motion of each piston 68 along the cylinder bore 59 of its respective piston cylinder 60. As described above, by using a single cam 82 to drive each of the at least three pistons 68, combined with, in this example, the 120 degree spacing of the pistons 68 around the crankshaft axis 100, the motion of each piston 68 and the suction/discharge cycle of each diaphragm 80 is either 120 or 240 degrees out of phase with the other pistons 68 and their associated diaphragms 80.

In certain embodiments, the electric diaphragm pump 10 is configured to provide flow rates in the range of about 0 gallons to about 300 gallons per minute, at pressures within the range of approximately 0 pounds-per-square inch (psi) to approximately 500 psi through inlets and outlets that range in diameter from about ¼ inch to about 6 inches. Embodiments of the present disclosure are also configured to provide a dry lift of at least 15 feet. According to certain embodiments, the electric diaphragm pump is capable of performing a wet lift of at least about 20 feet, and preferably at least about 30 feet.

Figure 9:
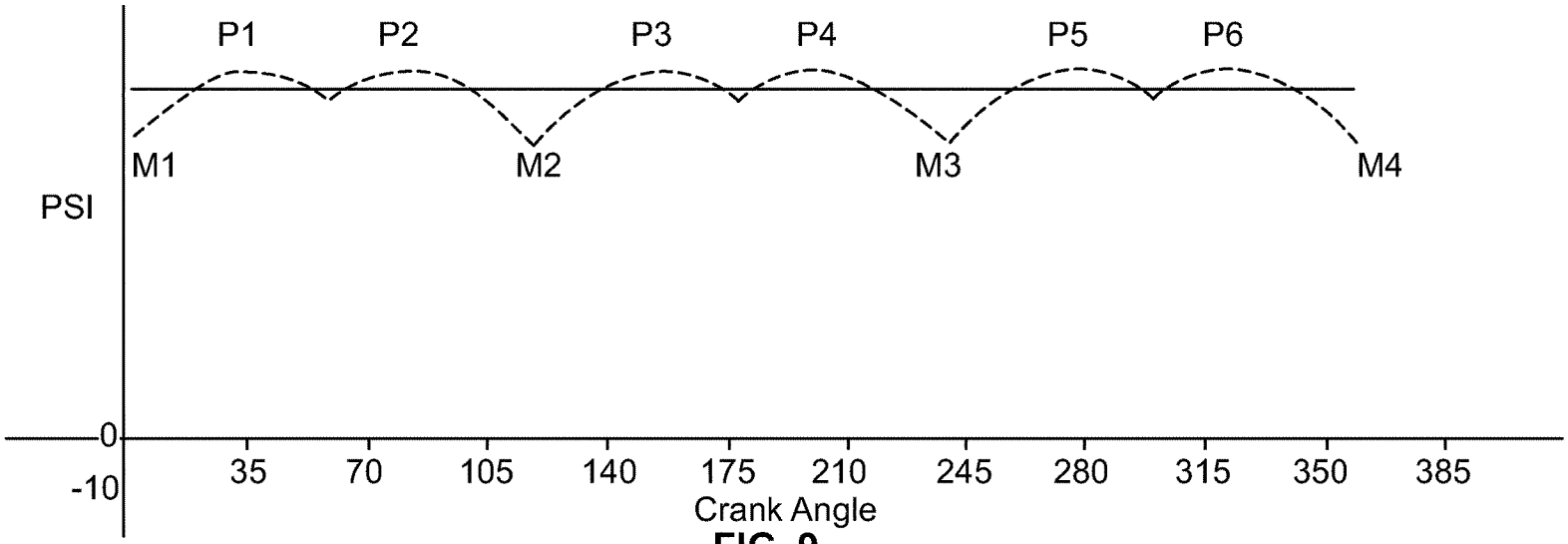
FIG. 9 illustrates a graph showing outlet pressure at a common outlet of an electric diaphragm pump having three diaphragm housings as a function of crank angle in accordance with an illustrated embodiment of the present disclosure.

FIG. 9 illustrates a chart showing outlet pressure (dotted line) at a common outlet of an exemplary diaphragm pump 10 having three diaphragm housings 18 as a function of crank angle. As shown, the use of three diaphragms 80 that have out of phase suction/discharge cycles can generate a pressure profile that results in six outlet maximum pressure peaks (P1-P6) per rotation of the crankshaft 40. As shown, these six maximum pressure peaks per 360 degree cycle of the diaphragm pump 10 are fairly level, with the maximum pressure of these peaks varying only slightly from the median pressure, as indicated by the solid line that extends through the chart, and the minimum outlet pressure (M1-M4) at the common outlet, which, as shown, also varies only slightly from the median pressure.

Figure 10:
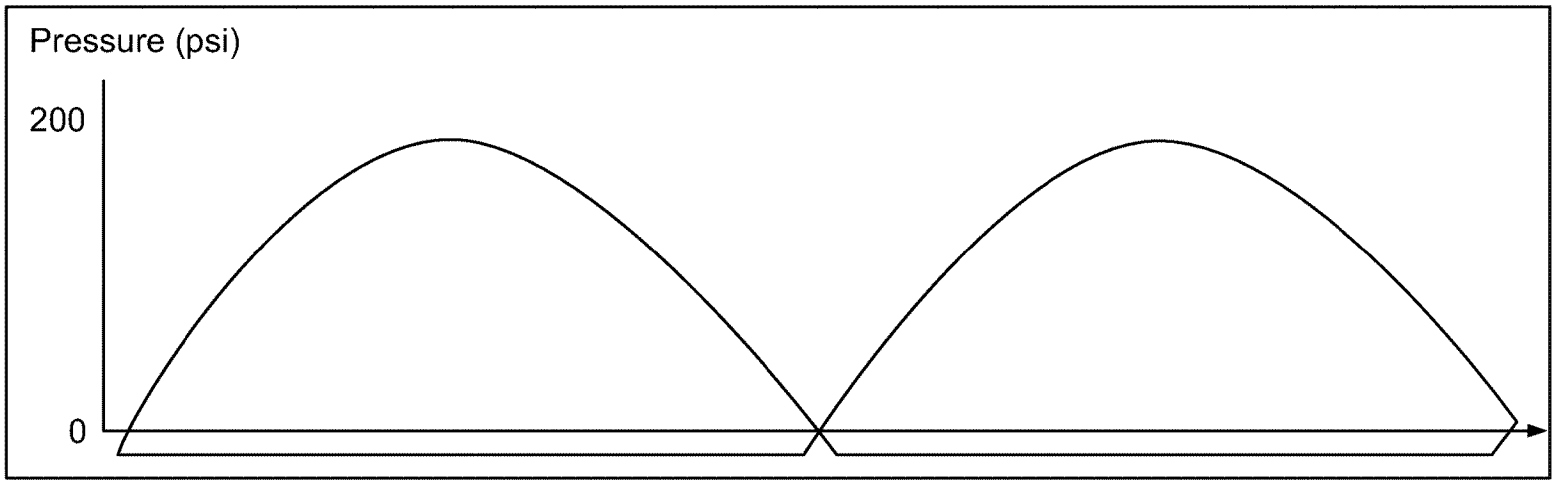
FIG. 10 PRIOR ART
FIG. 10 illustrates a graph showing outlet pressure as a function of pump cycle in a prior art double diaphragm pump.

FIG. 10 illustrates a chart showing outlet pressure as a function of pump cycle in a prior art double diaphragm pump. As shown in FIG. 10, a prior art double diaphragm pump may only generate two maximum pressure peaks per 360 degree cycle of a double diaphragm pump. Further, the difference between the peak outlet pressures and the minimum outlet pressure through each cycle of a prior art double diaphragm pump is greater than in the differences between the maximum and minimum outlet pressures that can be attained using an electric diaphragm pump 10 of the subject disclosure that has three diaphragm housings 18.

Comparison of the pressure curves of FIGS. 9 and 10 shows the marked improvement in reduced pressure pulsation and improved average pressure that can be attained by embodiments of the pump 10 of the subject disclosure that include three diaphragm housings 18 over that of traditional dual diaphragm pumps. Furthermore, compared to traditional double diaphragm designs, the three diaphragm pump 10 embodiments of the subject disclosure can reduce the magnitude of forces on the system 50 by spreading the load over three diaphragms assemblies 18.

Additionally, the diaphragm pump 10 can be designed to avoid buildup of pressure when the diaphragm pump 10 is faced with a stall situation. Moreover, diaphragm pumps are often used in industrial processes that require or otherwise result in temporary flow disruptions. Such disruptions in flow can be intentional, such as, for example, via an operator closing a valve to a nozzle, or can be unintentional, such as resulting from an unexpected blockage in a flow path. In typical air operated diaphragm pumps, air motors are designed such that a total flow disruption, often called a stall, avoids the buildup of pressure in the process fluid even as air continues to be delivered to the pump.

With respect to the diaphragm pump system 50 of the subject disclosure, for example, the driver 14, such as, for example, an electric motor, of the diaphragm pump 10 can be designed and controlled to slow, and even stop, as backpressure builds during a stall event. For example, according to certain embodiments in which the driver 14 is an electric motor, the driver 14 can have a pulse width modulation (PWM) based VFD controller 15 and be capable of a constant torque mode, a constant speed mode, or a combination thereof. By programing the VFD controller 15 to operate at a desired, or predetermined, torque across a range of motor speeds, the driver 14 can be designed to vary its speed to maintain the desired torque, including running at very slow speeds. When facing a stall event, as discharge flow is backed up to the outlets of the pump 14, the motor torque required of the driver 14 to drive the pistons 68 typically increases. Use of a torque-controlled driver 14 can facilitate the control systems for the driver 14 to decrease the revolutions-per-minute (rpm) of the driver 14 so as to not exceed a predetermined threshold torque placed on the driver 14. By the use of this control, the rpm of the driver 14 can decrease and, in fact, cease so long as the system places an over-threshold torque on the driver 14. Consequently, dangerously high backpressures in the discharge lines from the diaphragm pump 10 can be avoided.

Additionally, according to certain embodiments, the driver 14 can be designed to maintain a constant speed up to a threshold torque. Thus, when below the threshold torque, the driver 14 can be designed to maintain a selected speed even if backpressure changes, which can otherwise impact the amount of torque on the driver 14. The constant speed of the driver 14 can be designed or selected to maintain substantially the selected flow rate of the diaphragm pump 10. Above the threshold torque, the driver 14 can be controlled to maintain the torque at the threshold by reducing speed until the drive shaft 19 of the driver 14 is rotating relatively very slowly, or stopped in a stall scenario, so as to maintain, but not build up pressure, in the system.

In such embodiments, because the driver 14 is designed or configured to maintain pressure in the system 50 by holding a torque at or below the selected threshold, at the end of a stall event, when the stall condition is lifted, such as, for example, via opening of valves or flow in a discharge line, pressure of pumped fluid is substantially immediately available. Further, the torque required of the driver 14 would drop below the selected torque threshold, the control systems would actuate increased rpm of the driver 14, and discharge flow could proceed from zero to the target flow rate. In other embodiments, if the stall event persists beyond a predetermined time limit, such as, for example, a one-hour time limit, the control system 12 can override and shut off the VFD controller 15 of the driver 14.

Embodiments of the present disclosure can also present relatively significant energy utilization efficiencies. For example, with respect to wire-to-water efficiency, and, more specifically, from the amount of electrical energy used to operate the driver 14 to the amount of kinetic energy transferred by the diaphragm pump 10 to the process fluid exiting the diaphragm pump 10, certain embodiments can attain greater than 50 percent efficiency across a majority of the designed operating range of the diaphragm pump 10. Further, according to certain embodiments, such efficiency can be greater than 60 percent, and, in some embodiments, an about 65 percent efficiency can be attained.

Embodiments of the present disclosure can also provide significantly reduced acoustic, or noise, profiles from those associated with many dual diaphragm pumps. Because the crankshaft 40 of the diaphragm pump 10 continuously rotates in one direction during operation (absent stall events), and the diaphragms 80 are coupled to the cam 82 by substantially rigid connections, movements of the components of the pump 10, and particularly of the diaphragms 80, are substantially smooth, without the intermittent sudden movements and accompanying acoustic shock that typically characterizes the operation of dual diaphragm pumps. Such designs of embodiments of the subject disclosure can also minimize or eliminate noisy lost-motion connections and generated impact noise. Further, noise associated with operation of drivers 14, such as, for example, electric motors, is often more quiet than drive noise from compressed air and air motors of AODP. Consequently, the operational acoustic profiles of embodiments of the present disclosure can provide a marked advantage compared to traditional designs in terms of operation and work environment placement.

Additionally, during operation, the degree of the forces that act on the diaphragm pump 10 during the suction stroke versus those that act on the diaphragm pump 10 during the compression stroke can be very different. For example, at least certain components of the diaphragm pump 10 utilized in the displacement of the diaphragms 80 can experience a relatively significant higher level of load forces on the discharge stroke than the forces that those components encounter during the return/suction stroke. Accordingly, such components may experience higher wear rates on, and require increased mechanical integrity for, the discharge portion of the stroke.

Figure 11A:
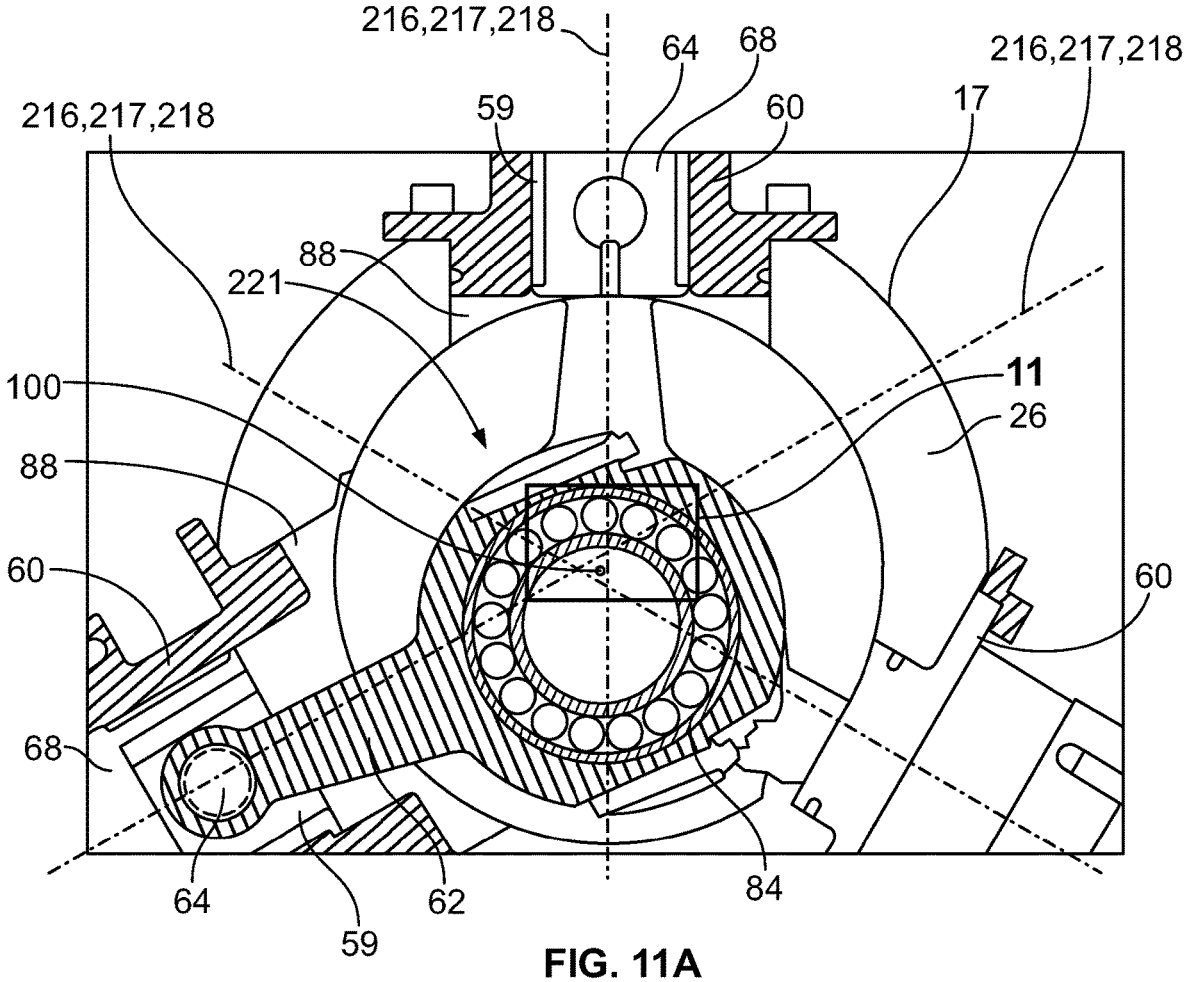
FIG. 11A illustrates a cross sectional view of a portion of an electric diaphragm pump having a linearly offset slider crank mechanism according to an illustrated embodiment of the subject disclosure.
Figure 11B:
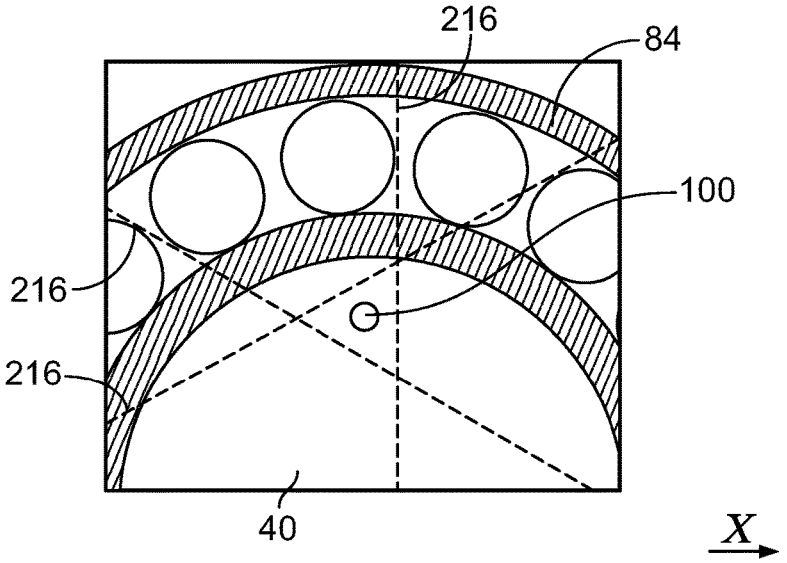
FIG. 11B illustrates an enlarged view of box 11B from FIG. 11A depicting linearly offset centerlines of piston cylinders of an offset slider crank mechanism according to an illustrated embodiment of the subject disclosure.

Referencing FIGS. 11A and 11B, according to certain embodiments, the slider crank mechanism 221 can have one or more pistons 68 that are displaced in a reciprocating manner within a corresponding piston cylinder 60 along an axis of motion 216 that is offset, and thus located out of plane, from the rotational axis 100 of the crankshaft 40. According to certain embodiments, the axis of motion 216 intersects the corresponding connection at the wrist pin 64 of the piston 68 to the connecting rod 62. Thus, according to at least certain embodiments, the axis of motion 216 extends through both the location at which the center of the wrist pin 64 is positioned when the piston 68 completes the discharge stroke, and the location at which the center of the wrist pin 64 is positioned when the piston 68 completes the suction stroke. Moreover, the locations of the center of the wrist pin 64 when the piston 68 completes the discharge and suction strokes can be positioned on a central axis of the wrist pin 68 that is generally positioned along, or shared by, the axis of motion 216. The degree of offset between the axis of motion 216 and the rotational axis 100 of the crankshaft 40 can, according to certain embodiments, be a distance between at least the axis of motion 216 and the rotational axis 100 of the crankshaft 40. Further, while FIGS. 11A and 11B depict the slider crank mechanism 221 as having three pistons 68, as well as, three associated piston cylinders 60 and connecting rod 62, the number of pistons 68 and associated components utilized with the slider crank mechanism 221 can vary for different disclosures.

Offsetting of the axis of motion 216 relative to the rotational axis 100 of the crankshaft 40 can be achieved in a variety of different manners. For example, the slider crank mechanism 221 depicted in FIGS. 11A and 11B is configured such that the axis of motion 216 along which the associated piston 68 is displaced in a reciprocating manner is linearly offset from the rotational axis 100 of the crankshaft 40. Such linear offsetting can be achieved, for example, by linearly adjusting the location of the axis of motion 216 such that the axis of motion 216 does not intersects, and is offset from, the rotational axis 100 of the crankshaft 40. For example, and at least for purposes of discussion, the generally vertical orientation of the axis of motion 216 associated with a third piston 68 shown in FIG. 11B is offset in a generally horizontal direction (as indicated by the direction "x" in FIG. 11B) such that rather than intersecting the rotational axis 100 of the crankshaft 40, the axis of motion 216 instead is offset to the right side of the rotational axis 100.

Such linear offsetting of the axis of motion 216 of the slider crank mechanism 221 can be achieved in a variety of different manners. For example, according to certain embodiments, the cylinder bore 59 can be positioned or oriented such that the central longitudinal axis 218 of the cylinder bore 59 is linearly offset from the rotational axis 100 of the crankshaft 40. As the axis of motion 216 associated with the reciprocal displacement of the piston 68 within the cylinder bore 59 can be coplanar to the central longitudinal axis 218 of the cylinder bore 59, offsetting of the central longitudinal axis 218 relative to the rotational axis 100 of the crankshaft 40 can result in similar offsetting of the axis of motion 216 relative to the rotational axis 100 of the crankshaft 40. Thus, according to such embodiments, the central longitudinal axis 218 of the cylinder bore 59 and the corresponding axis of motion 216 can be offset by generally the same distance or magnitude, and in the same direction, from the rotational axis 100 of the crankshaft 40.

Alternatively, as previously discussed, and as shown in at least FIG. 11A, the lower crankcase 26 can include one or more apertures 88 that are each sized and positioned to receive, or otherwise be coupled to, at least a portion of a piston cylinder 60. Such apertures 88 can be positioned and/or oriented such that the central longitudinal axis 217 of the aperture 88 is linearly offset from the rotational axis 100 of the crankshaft 40. Moreover, according to certain embodiments, such a central longitudinal axis 217 of the aperture 88 can be positioned such that, when the piston cylinders 60 are attached to the lower crankcase 26 and the slider crank mechanism 221 is assembled, the axis of motion 216 of the associated piston 68 is coplanar to the central longitudinal axis 217 of the aperture 88, and the central longitudinal axis 217 of the aperture 88 and the corresponding axis of motion 216 are therefore offset by generally the same distance or magnitude from the rotational axis 100 of the crank shaft 40.

As shown by at least FIG. 11B, according to the illustrated embodiment in which the slider crank mechanism 221 includes at least three pistons 68, the axes of motion 216 for each of the pistons 68 can be offset from the rotational axis 100 of the crankshaft 40. Further, each axis of motion 216 may thus be oriented such that all three axes of motion 216 do not all intersect at any common point.

Additionally, the magnitude of the offset between the axes of motion 216 and the rotational axis 100 of the crankshaft can be based on a variety of criteria, including, for example, but not limited to, stroke length. For example, according to certain embodiments, the axes of motion 216 may be offset from the rotational axis 100 of the crankshaft 40 by a distance of 0.1 inches to around 0.5 inches, and more specifically, offset by about 0.157 inches, among other distances.

The offset features of the slider crank mechanism 221 can be configured to increase the duration of the discharge stroke during displacement of the piston 68 and associated operation of the diaphragm housings 118. As the degree of forces and stresses encountered on the discharge stroke can often be higher than those encountered on the suction stroke, increasing the amount of time spent on the discharge stroke can improve a balance between the piston side load forces and stresses that can be encountered during the discharge and suction strokes. As a result, the offset features of the slider crank mechanism 221 can reduce the maximum forces and stresses that are experienced by at least certain components of the slider crank mechanism 221 and/or the diaphragm housings 118. Such reduction of maximum forces and stresses can eliminate or reduce any need to overdesign at least the offset slider crank mechanism 221 and/or the diaphragm housings 118 of the pump 10, which can provide a cost savings. Further, such improved balancing of forces can facilitate a better balance of the expected wear on the diaphragms 80, as well as the wear between at least the interface between the piston cylinders 60 and the associated piston 68, sleeve or rider band 70, and/or an associated linear guide assembly (FIGS. 15A and 15B), and thereby extend the useable life span of such components.

Figure 12:
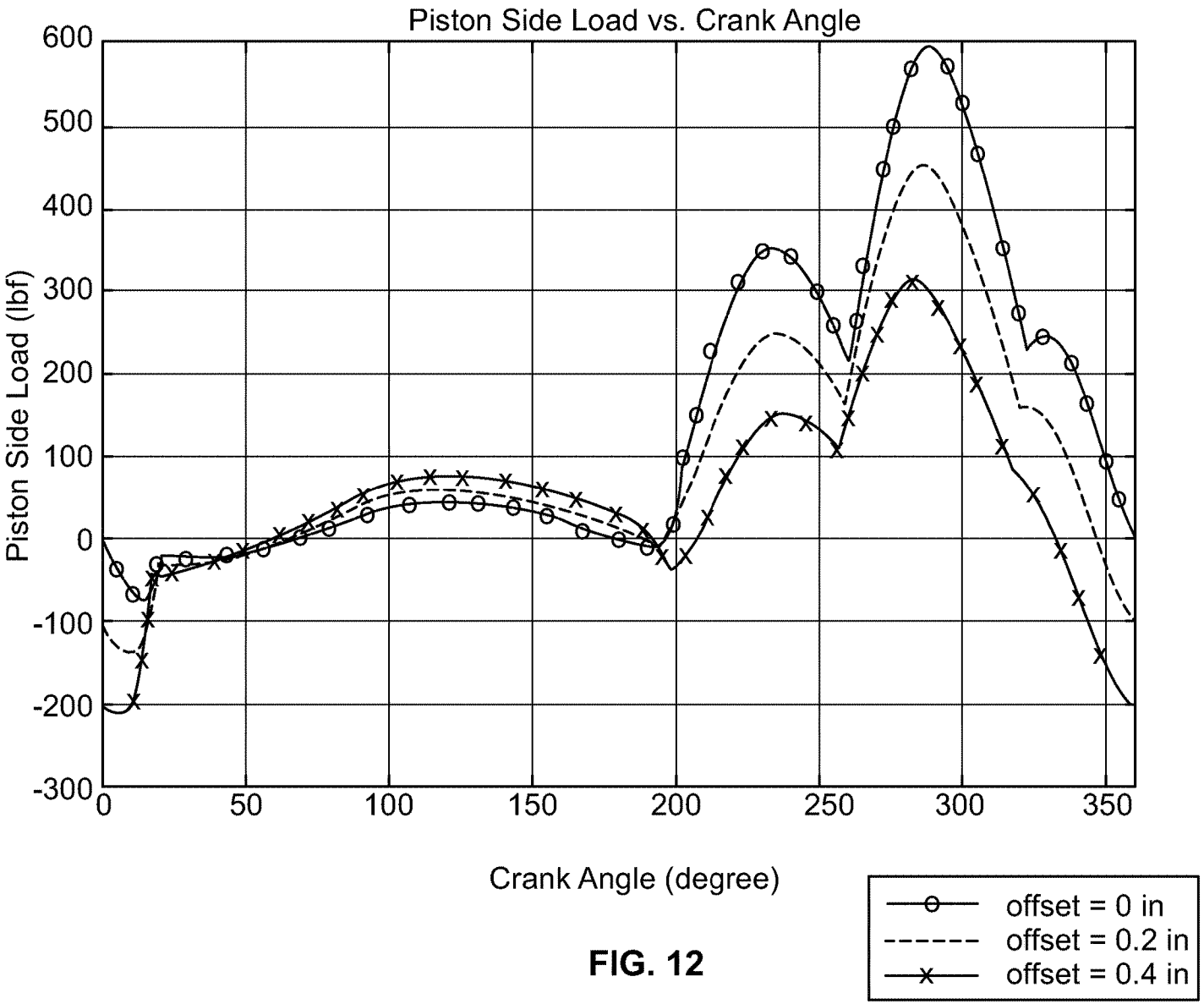
FIG. 12 illustrates a graph depicting an example of the impact an offset design for a slider crank mechanism can, as a function of crank angle, have on piston side loading.

For example, FIG. 12 provides a chart depicting examples of piston side load as a function of crank angle for slider crank mechanisms 221 of diaphragm pumps 10 having three levels of offset distance of the axes of motion 216 from the rotational axis 100. With respect to the slider crank mechanism not having an offset feature (e.g., "offset=0 in."), for example slider crank 21 of FIG. 3, as shown by the chart of FIG. 12, during the suction stroke, the illustrated piston side load force drops, at its lowest, to around −80 pounds-force (lbf), and reaches a maximum of around 600 lbf during the discharge stroke. In other words, in this example, without the offset feature, the maximum piston side load during the discharge stroke is about 7.5 times larger than the maximum piston-side load experienced during the suction stroke. However, for a slider crank 221 having an offset, when the axis of motion 216 in this example is offset from the rotational axis 100 by an offset distance of 0.2 inches, an improved balance between the piston side load forces between the suction and discharge strokes is shown, as indicated by the piston side load force on the suction stroke reaching about −130 lbf, and the maximum piston side load force during the discharge stroke being about 450 lbf. Thus, in this example, with an offset of 0.2 inches between the axis of motion 216 and the rotational axis 100, the maximum piston side load forces during the discharge stroke drops to being about 3.5 times larger than the maximum piston side load forces on the suction stroke. As further seen in this example, such balancing of the piston side load force between the discharge and suction stroke can further be enhanced by increasing the offset distance to 0.4 inches. Moreover, with an offset distance of 0.4 inches, the maximum piston side load forces for the suction and discharge strokes in this example are around 200 lbf and around 300 lbf, respectively. Thus, with an offset of 0.4 inches, the maximum piston side load force for the discharge stroke drops to be about 1.5 times larger than the maximum piston side load force for the suction stroke. Accordingly, variations in the offset distance can reduce a peak magnitude of piston side load forces encountered during the discharge stroke while increasing a peak magnitude of piston side load forces encountered during the suction stroke. As a result, a closer balance can be attained between the piston side load forces that are encountered during the discharge and suction strokes.

Thus, as demonstrated by the examples shown in FIG. 12, by providing a slider crank mechanism 221 with an offset feature, the diaphragm pump 10 can be designed and built using components that can withstand lower levels of forces. Moreover, with reference to the data shown in FIG. 12, rather than building a diaphragm pump 10 that can at least withstand maximum piston side load forces of around 600 lbf, as shown as being experienced by the example slider crank mechanism 221 that had no offset feature, the diaphragm pump 10 can instead be built to at least withstand maximum piston side load forces of around 300 lbf, as shown as being experienced by the example slider crank mechanism 221 having an offset of 0.4 inches. Such a reduction of maximum forces and stresses via incorporation of offset features into the slider crank mechanism 221 can thus reduce, if not eliminate, any need to overdesign, such as, for example, oversize, components of at least the slider crank mechanism 221, which can provide cost and size advantages in terms of the components and manufacturing of the diaphragm pump.

Figure 13:
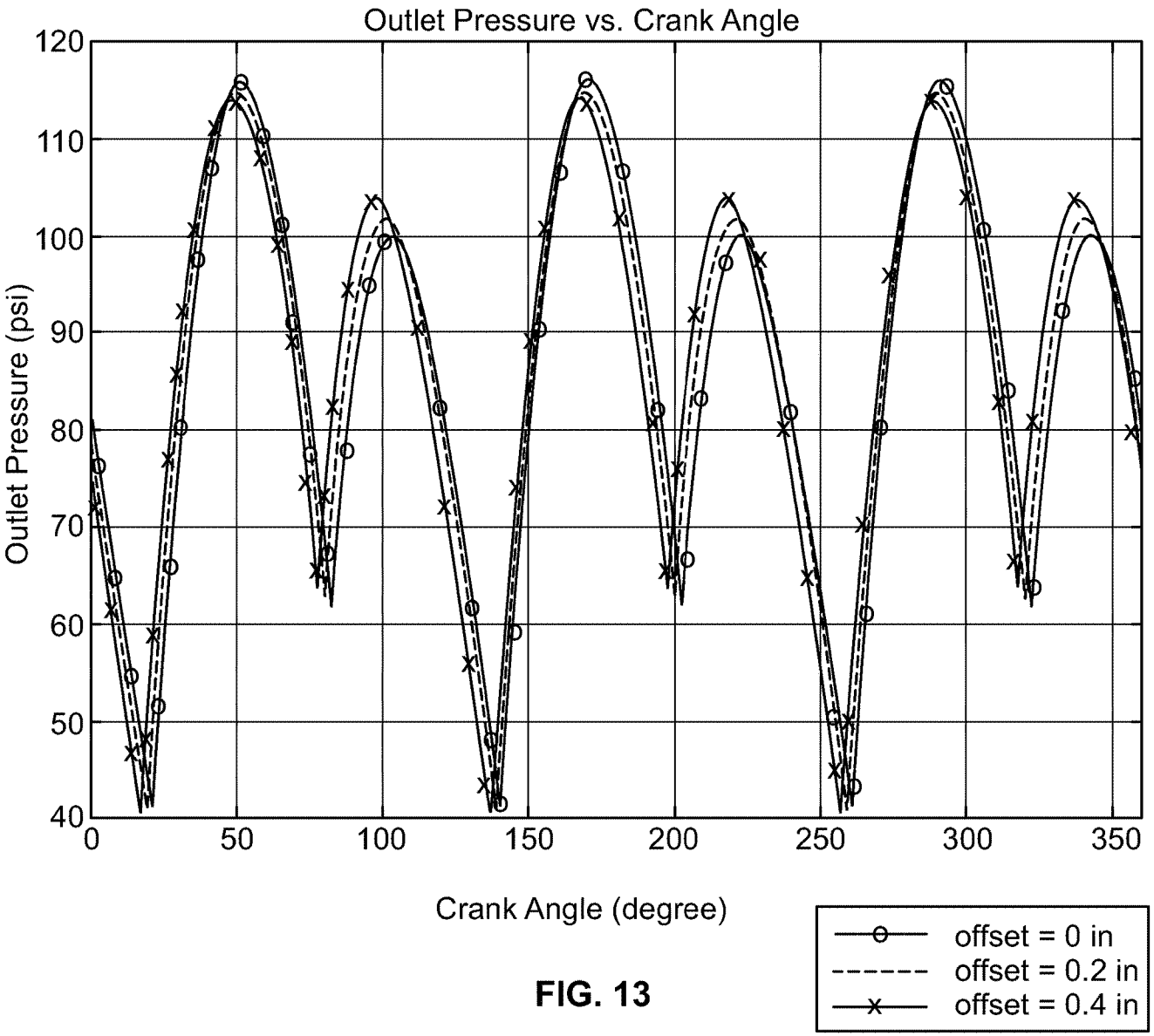
FIG. 13 illustrates a graph depicting an example of the impact an offset design for a slider crank mechanism can, as a function of crank angle, have on pump outlet pressure.

The incorporation of offset features into the slider crank mechanism 221, and the associated improved balancing of piston side load forces and stresses that can be encountered during discharge and suction strokes, can be provided without significantly changing the overall outlet pressure of the diaphragm pump 10. For example, FIG. 13 provides a chart depicting examples of pump outlet pressure, as measured in pounds square inch (psi), as a function of crank angle for the slider crank mechanisms 21, 221 of diaphragm pumps 10 having the same three levels of offset as are depicted in FIG. 12. The outlet pressure shown in FIG. 13 can be the combined pressure effect of a diaphragm pump 10 having three diaphragm housings 118, and thus three corresponding pistons 68. As shown by FIG. 13, the overall outlet pressure of the diaphragm pump 10 generally remains the same for each of the three levels of offset. Further, the extent that FIGS. 12 and 13 illustrate maximum piston side load forces and maximum/minimum pressures occurring at different crank angles, such differences can be attributed to at least changes in the durations of the suction and discharge strokes, as previously discussed.

Additionally, similar to FIG. 9, FIG. 13 also demonstrates the use of an odd number of diaphragm housings 118 as increasing the number of pressure peaks that occur per each operating cycle. Moreover, with respect to diaphragm pumps 10 having an odd number of diaphragm housings 118, the number of pressure peaks can be equal to two times the number of diaphragm housings 118. Accordingly, as the data depicted in FIG. 13 corresponds to an exemplary diaphragm pump 10 having three diaphragm housings 118, and the number of pressure peaks that occur per cycle is six, with three pressure peaks being generally around 115 psi and three other pressure peaks being generally around 102 psi. Conversely, with respect to diaphragm pumps that have an even number of diaphragm housings, the number of pressure peaks is typically equal to the number of diaphragm housings as each diaphragm has only one pressure peak. The additional pressure peaks provided by the use of an odd number of diaphragm housings 118 can be the product of the increased duration of the overlapping time periods in which multiple diaphragm housings 118 are undergoing discharge strokes. Moreover, by increasing the duration of the discharge strokes for each diaphragm housing 118, via use of the offset features of the slider crank mechanism 221 of the subject disclosure, the duration at which multiple diaphragm housings 118 are simultaneously undergoing discharge strokes can also be increased. Further, as previously discussed, the increase in the number of pressure peaks per cycle can enhance loading sharing by the diaphragms 80 of the pump 10, as well as improve the average pressure that can be attained by the pump 10.

Figure 14:
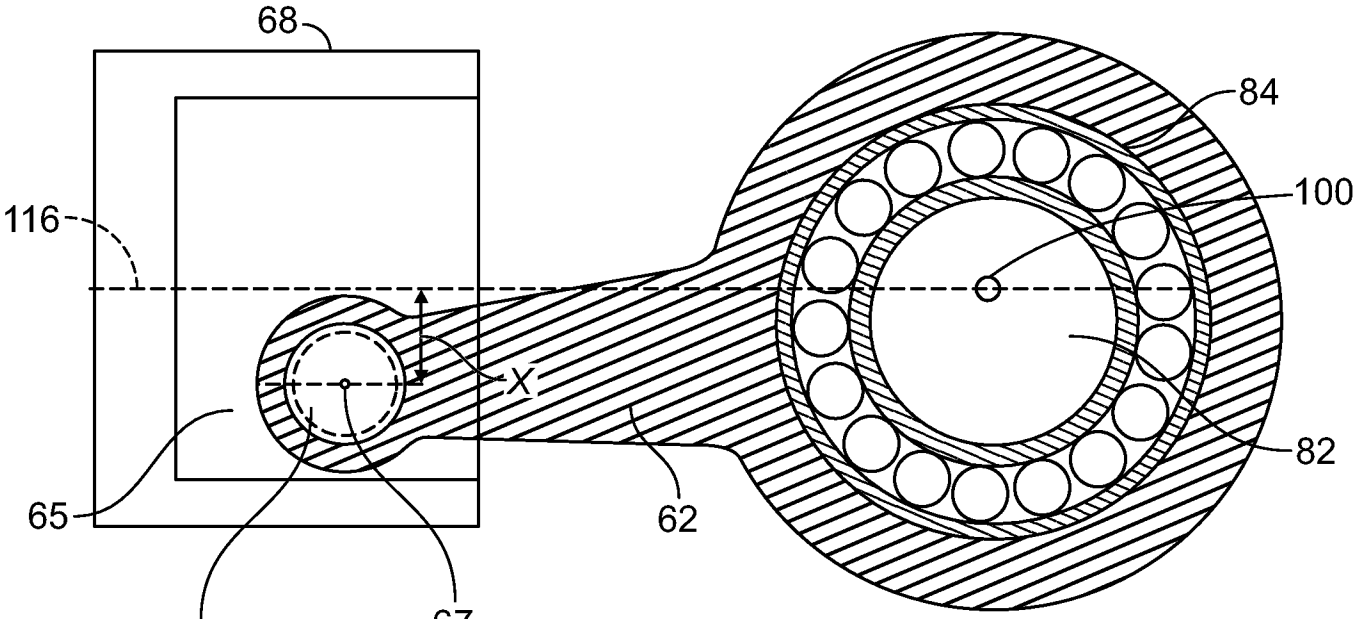
FIG. 14 illustrates a wrist pin housed in a wrist pin cavity in a piston that is linearly offset from a corresponding cylinder axis.

While the preceding examples are discussed in terms of a linear offset of the axis of motion 216 of the slider crank mechanism 221 relative to the rotational axis 100 of the crankshaft 40, the offset feature of the slider crank mechanism 221 can be provided in a variety of other manners. For example, according to certain embodiments, rather than offsetting the axis of motion 216, the wrist pin 64 can be linearly offset from the corresponding cylinder axis 116. For example, FIG. 14 illustrates a wrist pin 64 housed in a wrist pin cavity 65 in a piston 68 that is attached to a connecting rod 62 that is coupled to a cam 82. As shown, the cylinder axis 116 for a corresponding piston cylinder 60 (not shown), which also can serve as the axis of motion along which the piston 68 is reciprocally displaced, is positioned to intersect the rotational axis 100, with the rotational axis 100 not being positioned at the center of the cam 82. However, the central longitudinal axis 67 of the wrist pin 64 is positioned on the piston 68 at a location that is linearly offset from cylinder axis 116, as indicated by the distance "X" in FIG. 14. According to the illustrated embodiment, this linear distance may be based on a distance from the central longitudinal axis 67 of the wrist pin 64 and/or wrist pin cavity 65 in a direction that is generally orthogonal to the cylinder axis 116. Further, such an offset of the wrist pin 64 and/or wrist pin cavity 65 can provide the connecting rod 62 with an adjusted angle of attack relative to the piston 68 that can at least increase the duration of the discharge stroke, which, again, can facilitate an improved balance of forces experience by the piston 68 during the suction and discharge strokes.

Figure 16:
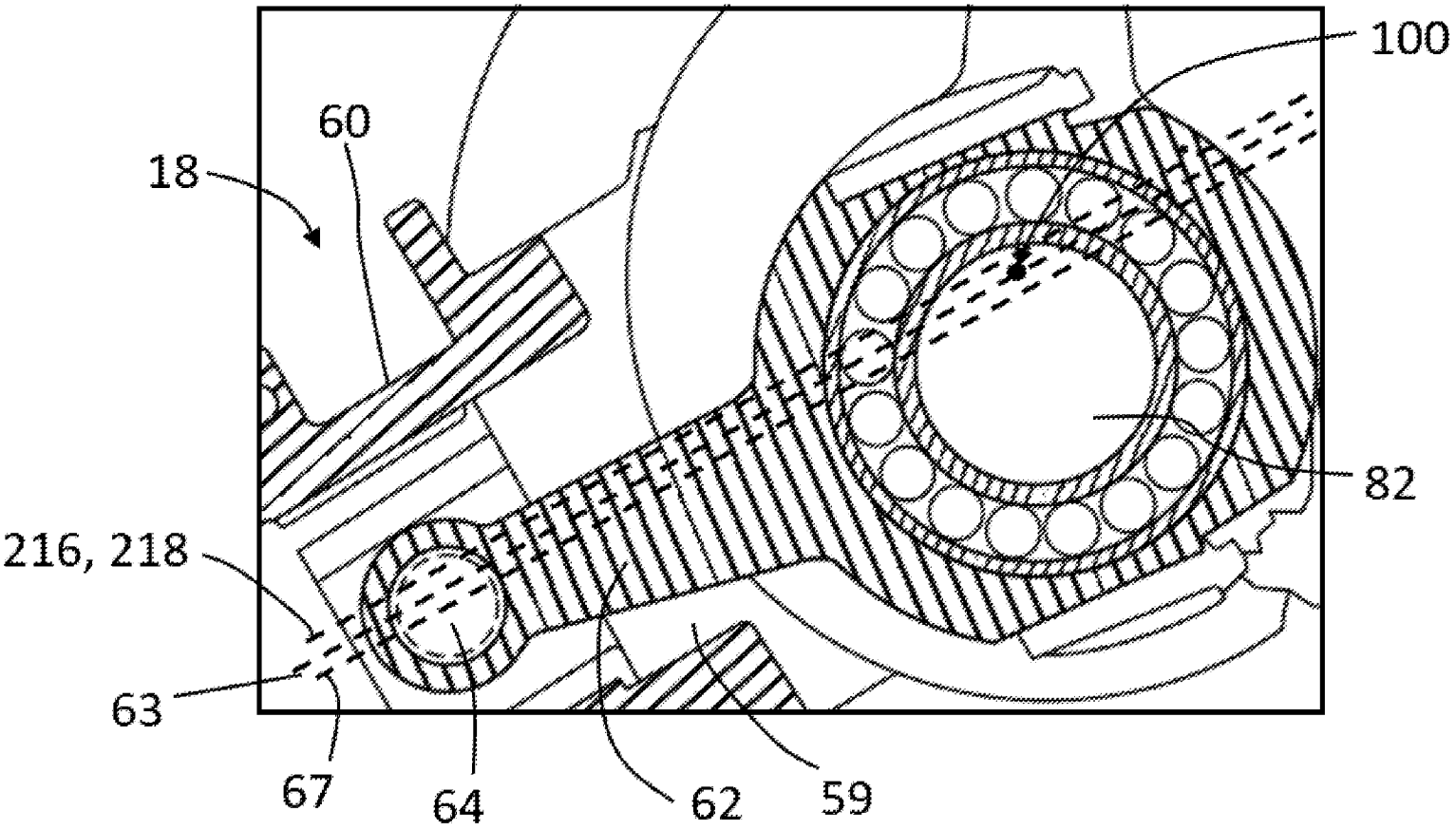
FIG. 16 illustrates an enlarged view a portion of a diaphragm pump in which an axis of motion is angularly offset relative to at least the rotational axis.

Referencing FIG. 16, according to other embodiments, rather than being linearly offset, the pump 10 can include a slider crank mechanism 221 in which the axis of motion 216 for each diaphragm housing 18 is angularly offset relative to at least the rotational axis 100 of the crankshaft 40 such that the axis of motion 216 does not intersect the rotational axis 100. According to certain embodiments, such offsetting of the axis of motion 216 can be achieved by angularly offsetting the central longitudinal axis 218 of the cylinder bore 59 of the piston cylinder 60 relative to at least the rotational axis 100 of the crankshaft 40. Such angular offsetting of the axis of motion 216 and central longitudinal axis 218 of the cylinder bore 59 relative to at least the rotational axis 100 can be achieved in a variety of manners. For example, according to certain embodiments, the cylinder bore 59 can be formed in the piston cylinder 60 such that the central longitudinal axis 218 of the cylinder bore 59 is angularly offset relative to a central longitudinal axis 63 of the piston cylinder 60. According to such an embodiment, the central longitudinal axis 63 of the piston cylinder 60, and not the central longitudinal axis 218 of the cylinder bore 59, can be positioned and oriented to intersect the rotational axis 100. According to such an embodiment, as the axis of motion 216 may extend along the central longitudinal axis 218 of the cylinder bore 59, the axis of motion 216 may therefore also be offset relative to the rotational axis 100. Additionally, according to such an embodiment, the wrist pin 64 can be positioned along a central longitudinal axis 67 of the wrist pin 64 that is parallel to, but linearly offset from, the axis of motion 216, as seen in FIG. 16.

Alternatively, according to other embodiments in which the central longitudinal axis 218 of the cylinder bore 59, and thus the axis of motion 216, each extend along the central longitudinal axis 63 of the piston cylinder 60, the piston cylinder 60 can be mounted to the lower crankcase 26 via the aperture 88 in a manner that causes each of the central longitudinal axis 63 of the piston cylinder 60, the central longitudinal axis 218 of the cylinder bore 59, and the axis of motion 216 to be angularly offset from, and not intersect, the rotational axis 100.

Figure 15A:
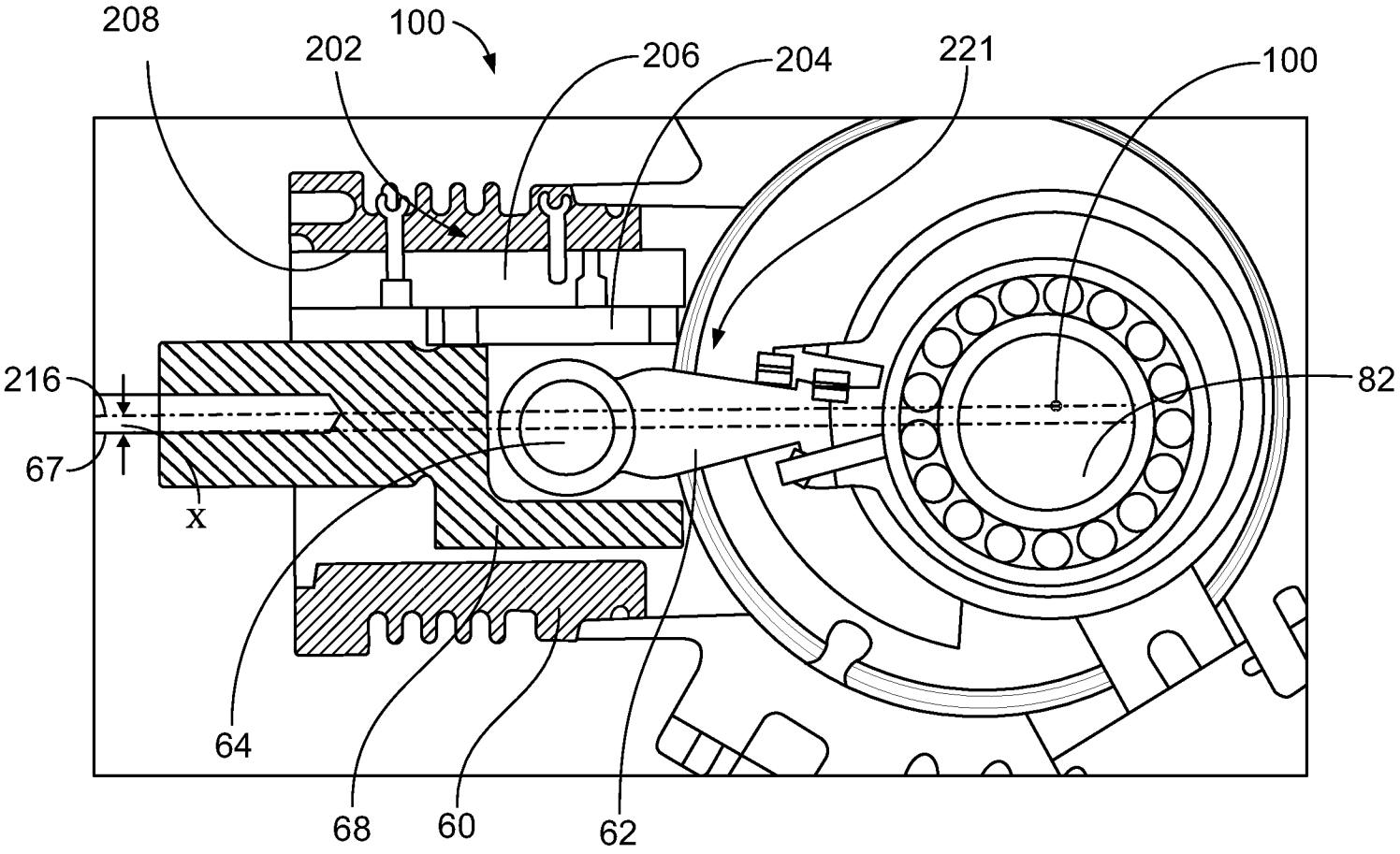
FIG. 15A illustrates an enlarged view a portion of a pump and an associated piston of a slider crank mechanism having an offset axis of motion and which reciprocal displacement of the piston is guided by a linear guide.

FIG. 15A illustrates an enlarged view a portion of a pump 10 and an associated piston 68 of a slider crank mechanism 221 in which reciprocal displacement of the piston 68 is guided by a linear guide or bearing assembly 202. According to the illustrated embodiment, the linear guide assembly 202 can include a bearing block 204, a plurality of balls or rollers (not shown), and a rail 206. The plurality of balls or rollers, which can function as bearings, can be positioned between the bearing block 204 and the rail 206 such that the balls or rollers are rotated as the bearing block 204 is linearly displaced along the rail 206, thereby assisting in the linear displacement of the bearing block 204 along the rail 206. Further, the bearing block 204 and rail 206 can having mating shapes so as facilitate the bearing block 204 being maintained in engagement with the rail 206, as well at least assist in maintaining the plurality of balls or rollers at an operable position between the bearing block 204 and the rail 206.

Figure 15B:
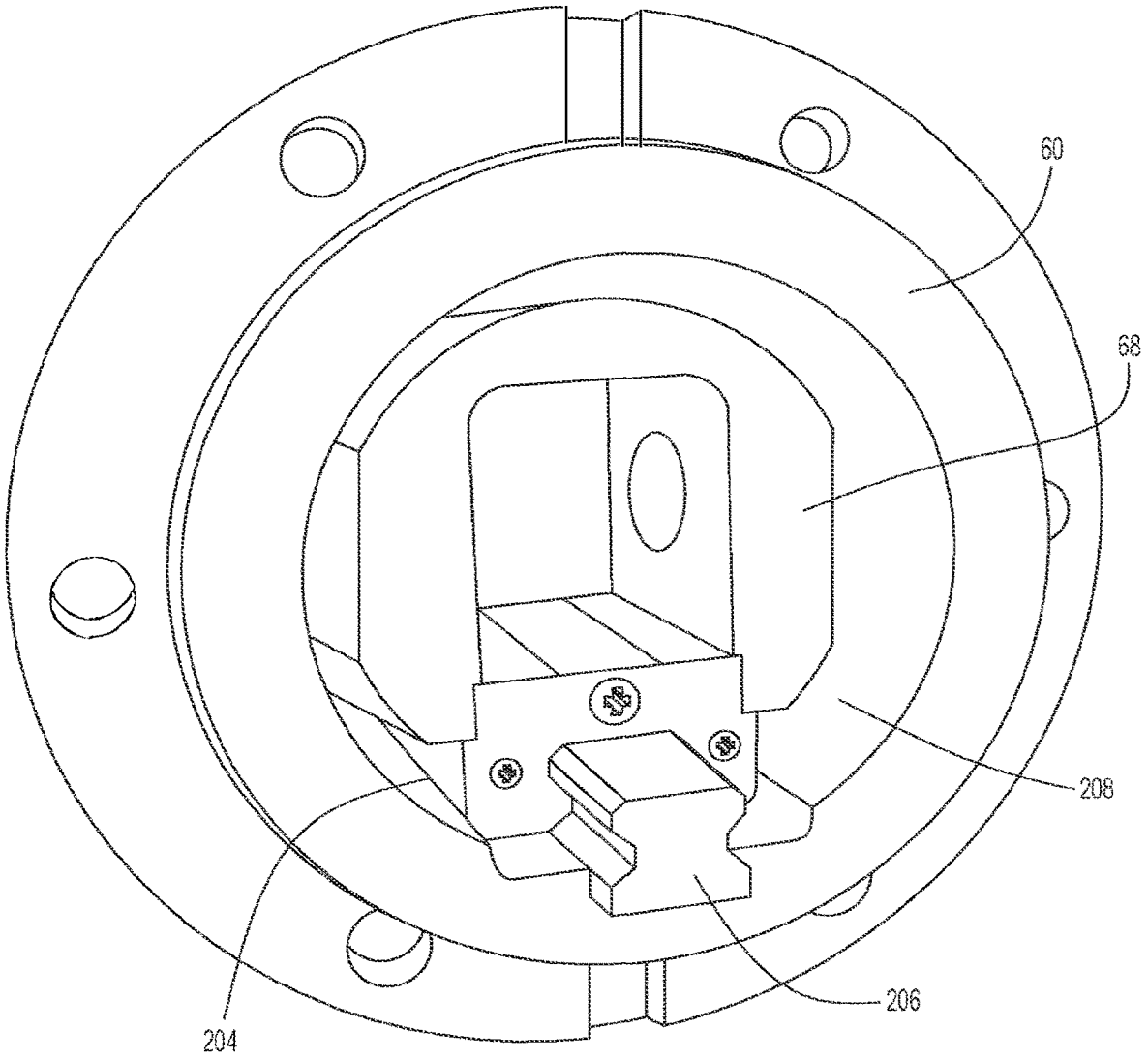
FIG. 15B illustrates a front side perspective view of a portion of a pump having a piston that is slidingly coupled to a piston cylinder by a linear guide.

As shown in FIGS. 15A and 15B, according to the illustrated embodiment, the rail 204 can be secured to an inner wall 208 of the piston cylinder 60, such as, for example, by one or more mechanical fasteners, including, but not limited, one or more bolts. Further, according to certain embodiments, at least a portion of the rail 206 can be recessed within a groove in an inner wall 208 of the piston cylinder 60. Similarly, the bearing block 204 can be secured to the piston 68 such that bearing block 204 is linearly displaced with the displacement of the piston 68. Thus, as the piston 68 is linearly displaced, such displacement of the piston 68 can be guided at least in a linear direction by the linear movement of the bearing block 204 along the rail 206. Moreover, according to certain embodiments, the linear guide assembly 202 can provide a rolling interface between the piston 68 and the piston cylinder 60. Further, according to certain embodiments, at least a portion of the piston 68 can have a shape and/or size that can accommodate placement of at least a portion of the linear guide assembly 202 within the piston cylinder 60.

Additionally, similar to the embodiment discussed above with respect to FIG. 14, FIG. 15A also illustrates an embodiment in which the cylinder axis 216 for the corresponding piston cylinder 60, which also can serve as the axis of motion along which the piston 68 is reciprocally displaced, is positioned to intersect the rotational axis 100 of the crankshaft 40, with the rotational axis 100 not being positioned at the center of the cam 82. However, similar to the embodiment discussed above with respect to FIG. 14, the central longitudinal axis 67 of the wrist pin 64 can be parallel to, but linearly offset from, the axis of motion 116, as indicated by the distance "X" in FIG. 15A. Such an offset of the wrist pin 64 can also provide the connecting rod 62 with an adjusted angle of attack relative to the piston 68 that can at least increase the duration of the discharge stroke, which can also facilitate an improved balance of the piston side load forces experience during the suction and discharge strokes.

While the linear guide assembly 202 is discussed above with respect to being used with a slider crank mechanism 221 having offset features similar to those shown in at least FIG. 14, the linear guide assembly 202 can also be used with other slider crank mechanisms that can have other types of offset features or configurations. Additionally, the linear guide assembly 202 can also be used with slider crank mechanisms that do not utilize offset features.

While the above examples are discussed with respect to a single piston cylinder and piston, and the associated axis of motion thereof, similar offset features can also be incorporated for any, if not all, of the other piston cylinders, pistons, and the associated axis of motion and/or the associated diaphragm housings.

While the invention has been described in connection with what is presently considered to be the most practical and preferred embodiment, it is to be understood that the invention is not to be limited to the disclosed embodiment (s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A diaphragm pump, comprising:

a crankcase;

a crankshaft at least partially disposed within the crankcase, the crankshaft having a crankshaft axis, and the crankshaft being configured to rotate during operation of the diaphragm pump;

three or more diaphragms that each at least partially define a pumping chamber, wherein each diaphragm of the three or more diaphragms is structured to reciprocate, along a respective cylinder axis oriented orthogonal to the crankshaft axis, between a first position and a second position to pump a fluid, wherein the three or more diaphragms are distributed evenly around the crankshaft axis such that angles formed between adjacent cylinder axes are substantially equal, each diaphragm having a first surface and a second surface opposite to the first surface, each diaphragm having a respective first washer configured to abut the first surface of the diaphragm upon reciprocation of the diaphragm toward the crankshaft, each diaphragm having a respective second washer configured to abut the second surface of the diaphragm upon reciprocation of the diaphragm away from the crankshaft;

a seal assembly configured to block flow of lubricant from the crankshaft to the first surface;

a cylinder for each of the three or more diaphragms, each cylinder arranged along its respective cylinder axis and housing a piston, the piston connected to the crankshaft by a connecting rod; and a respective cavity positioned between each diaphragm of the three or more diaphragms and a surface of its respective cylinder, wherein each diaphragm of the three or more diaphragms fluidly separates the respective cavity from a corresponding pumping chamber, each respective cavity contains low pressure air, and at least two of the respective cavities are configured to pass the low pressure air among one another to avoid pressure buildup within the respective cavities during reciprocating motion of the three or more diaphragms.

2. The diaphragm pump of claim 1, comprising three diaphragms distributed evenly around the crankshaft axis such that the angles formed between adjacent cylinder axes are each 120 degrees.

3. The diaphragm pump of claim 1, comprising a motor connected to the crankshaft, wherein the motor is configured to provide power to rotate the crankshaft during the operation of the diaphragm pump.

4. The diaphragm pump of claim 1, wherein each respective piston is coupled to each diaphragm of the three or more diaphragms such that rotation of the crankshaft drives reciprocation of the respective piston and each diaphragm along the respective cylinder axis.

5. The diaphragm pump of claim 4, wherein the rotation of the crankshaft drives the reciprocation of the respective piston through the respective cylinder.

6. The diaphragm pump of claim 5, wherein each respective cylinder comprises a diaphragm-facing surface, and the reciprocation of the respective piston through the respective cylinder maintains positioning of each diaphragm coupled to the respective piston within the pumping chamber and beyond the diaphragm-facing surface of the respective cylinder.

7. The diaphragm pump of claim 1, wherein each first surface and corresponding diaphragm cooperatively define a respective containment cavity in which the respective first washer is disposed.

8. A diaphragm pump comprising:

a crankshaft extending along a crankshaft axis and configured to rotate during operation of the diaphragm pump;

three or more cylinders distributed circumferentially evenly around the crankshaft axis, each cylinder arranged along its respective cylinder axis;

three or more pistons, wherein each piston of the three or more pistons is disposed within a respective cylinder of the three or more cylinders, each piston is connected to the crankshaft by a connecting rod, and rotation of the crankshaft drives movement of each piston of the three or more pistons within the respective cylinder to pump fluid;

three or more diaphragms, each diaphragm being coupled to a respective piston, each diaphragm having a first surface and a second surface opposite to the first surface, wherein a respective first washer is coupled to each diaphragm and is configured to abut the first surface of the respective cylinder upon reciprocation of its diaphragm toward the crankshaft, and a respective second washer is coupled to each diaphragm and is configured to abut the second surface of the respective cylinder upon reciprocation of its diaphragm away from the crankshaft;

a seal assembly configured to block flow of lubricant from the crankshaft to the first surface; and a respective cavity positioned between each diaphragm of the three or more diaphragms and a surface of its respective cylinder, wherein each diaphragm of the three or more diaphragms fluidly separates the respective cavity from a corresponding pumping chamber, each respective cavity contains low pressure air, and at least two of the respective cavities are configured to pass the low pressure air among one another to avoid pressure buildup within the respective cavities during reciprocating motion of the three or more diaphragms.

9. The diaphragm pump of claim 8, wherein the crankshaft comprises a cam having a central axis extending parallel to and offset from the crankshaft axis, and a piston of the three or more pistons is connected to the cam.

10. The diaphragm pump of claim 8, comprising three or more diaphragm housings, wherein each diaphragm housing of the three or more diaphragm housings defines a chamber, and the rotation of the crankshaft drives the movement of each piston of the three or more pistons relative to a corresponding diaphragm housing to pump fluid through the chamber defined by the corresponding diaphragm housing.

11. The diaphragm pump of claim 10, wherein the movement of each piston of the three or more pistons relative to the corresponding diaphragm housing moves a respective diaphragm to adjust a size of the chamber to pump fluid through the chamber.

12. The diaphragm pump of claim 11, wherein the rotation of the crankshaft drives the movement of each piston of the three or more pistons relative to the corresponding diaphragm housing to move the respective diaphragm into and out of engagement with a corresponding cylinder of the three or more cylinders.

13. The diaphragm pump of claim 12, comprising a motor configured to electrically drive the rotation of the crankshaft to drive the movement of each piston of the three or more pistons relative to the corresponding diaphragm housing.

14. The diaphragm pump of claim 13, wherein each respective diaphragm comprises a flexible portion coupled to the corresponding diaphragm housing, the movement of each piston of the three or more pistons relative to the corresponding diaphragm housing adjusts extension of the flexible portion along its corresponding diaphragm housing, and the flexible portion does not contact the first surface of the corresponding cylinder of the three or more cylinders during the movement of each piston of the three or more pistons.

15. The diaphragm pump of claim 8, wherein the respective first washer and the respective second washer associated with each respective diaphragm are positioned on opposite sides of the respective diaphragm to stabilize the respective diaphragm.

16. The diaphragm pump of claim 15, comprising a fastener extending through a piston of the three or more pistons, the respective first washer coupled to the piston, the respective diaphragm on which the respective first washer is positioned, and the respective second washer positioned on the respective diaphragm to couple the piston, the respective first washer, the respective diaphragm, and the respective second washer to one another.

17. A diaphragm pump, comprising:

a crankshaft extending along a crankshaft axis and configured to rotate during operation of the diaphragm pump;

three pistons connected to the crankshaft, each of the three pistons being connected to the crankshaft by a connecting rod, wherein rotation of the crankshaft drives movement of the three pistons along respective axes, and the three pistons are distributed around the crankshaft axis such that each angle formed between adjacent axes is 120 degrees;

three diaphragms, wherein each diaphragm is coupled to a respective piston of the three pistons, each diaphragm having a first surface and a second surface opposite to the first surface, a respective first washer is coupled to each diaphragm and is configured to abut the first surface upon movement of a corresponding piston toward the crankshaft, and a respective second washer is coupled to each diaphragm and is configured to abut the second surface upon movement of the corresponding piston away from the crankshaft;

a seal assembly configured to block flow of lubricant from the crankshaft to the first surface;

a cylinder for each of the three diaphragms, each cylinder arranged along its respective cylinder axis and housing one of the three pistons; and a respective cavity positioned between each diaphragm of the three diaphragms and a surface of its respective cylinder, wherein each diaphragm of the three diaphragms fluidly separates the respective cavity from a corresponding pumping chamber, each respective cavity contains low pressure air, and at least two of the respective cavities are configured to pass the low pressure air among one another to avoid pressure buildup within the respective cavities during reciprocating motion of the three diaphragms.

18. The diaphragm pump of claim 17, wherein the rotation of the crankshaft drives the movement of the three pistons along the respective axes to reciprocate relative to a corresponding cylinder.

19. The diaphragm pump of claim 17, comprising a motor configured to electrically rotate the crankshaft to drive the movement of the three pistons along the respective axes to move the three diaphragms along the respective axes.

20. The diaphragm pump of claim 17, wherein each first surface and corresponding diaphragm cooperatively define a respective containment cavity in which the respective first washer is disposed.

* * * * *